US009061540B2

(12) United States Patent
Windorski et al.

(10) Patent No.: US 9,061,540 B2
(45) Date of Patent: Jun. 23, 2015

(54) PAPERCLIP TAB

(75) Inventors: David C. Windorski, Woodbury, MN (US); Lori A. Starken, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 6 days.

(21) Appl. No.: 14/342,434

(22) PCT Filed: Sep. 4, 2012

(86) PCT No.: PCT/US2012/053597

§ 371 (c)(1),
(2), (4) Date: Mar. 3, 2014

(87) PCT Pub. No.: WO2013/036463

PCT Pub. Date: Mar. 14, 2013

(65) Prior Publication Data

US 2014/0201952 A1 Jul. 24, 2014

Related U.S. Application Data

(60) Provisional application No. 61/531,840, filed on Sep. 7, 2011.

(51) Int. Cl.
*B42F 1/02* (2006.01)
*B42F 1/08* (2006.01)
(Continued)

(52) U.S. Cl.
CPC ..... *B42F 1/02* (2013.01); *Y10T 156/1051* (2015.01); *Y10T 24/206* (2015.01); *Y10T 156/10* (2015.01);
(Continued)

(58) Field of Classification Search
CPC ..... B42F 1/02; B42F 1/12; G09F 3/14; G09F 3/16
See application file for complete search history.

(56) References Cited

U.S. PATENT DOCUMENTS 1,403,615 A * 1/1922 Matthews et al. ..... 24/67 CF
2,328,691 A * 9/1943 Swett, Jr. ..... 40/663
(Continued)

FOREIGN PATENT DOCUMENTS

EP 738411 4/1998
GB 2390393 1/2004
(Continued)

OTHER PUBLICATIONS

"[IN] Place System Clip Tabs" <http:/www.officemax.com/office-supplied/file-folders-accessories/inplace-system-by-peter . . . > [Retrieved from the internet on Jul. 18, 2011]; 1 page.
(Continued)

*Primary Examiner* — Gary Hoge
(74) *Attorney, Agent, or Firm* — Nicole J. Einerson

(57) ABSTRACT

A paperclip tab for coupling to an object. The paperclip tab can include a paperclip having a first leg and a second leg, and a sheet having a front surface and a rear surface opposite the front surface. The sheet can include a first portion, and a second portion overlapping at least part of the first portion, with the rear surface of the first portion and the rear surface of the second portion facing each another, such that a pocket is formed that can retain the first leg of the paperclip. At least a portion of the rear surface of the first portion can be adhered to at least a portion of the rear surface of the second portion. A recessed adhesive zone can be provided on a back of the paperclip tab positioned to face the object when the paperclip tab is coupled to the object.

23 Claims, 4 Drawing Sheets

(51) Int. Cl.

| | |
|---|---|
| ***B42F 21/06*** | (2006.01) |
| ***G09F 3/12*** | (2006.01) |
| *G09F 3/16* | (2006.01) |
| *B42F 1/12* | (2006.01) |
| *G09F 3/14* | (2006.01) |
| *B42D 5/00* | (2006.01) |

(52) U.S. Cl.

CPC ... *G09F 3/16* (2013.01); *B42F 1/12* (2013.01); *G09F 3/14* (2013.01); *B42D 5/003* (2013.01); *B42D 5/005* (2013.01); *B42F 1/08* (2013.01); *B42F 21/06* (2013.01); *G09F 3/12* (2013.01)

(56) References Cited

U.S. PATENT DOCUMENTS

| | | | | |
|---|---|---|---|---|
| 2,979,840 | A | 4/1961 | Eastman | |
| 3,225,469 | A | 12/1965 | Chase | |
| 3,290,810 | A * | 12/1966 | Morena | 40/641 |
| 3,691,140 | A | 9/1972 | Silver | |
| 3,857,731 | A | 12/1974 | Merrill, Jr. | |
| 3,900,642 | A | 8/1975 | Michel | |
| 4,166,152 | A | 8/1979 | Baker | |
| 4,286,358 | A * | 9/1981 | Levin | 24/67 R |
| 4,951,408 | A * | 8/1990 | Banks | 40/641 |
| 5,170,535 | A | 12/1992 | Strong | |
| 5,344,693 | A | 9/1994 | Sanders | |
| 5,458,938 | A | 10/1995 | Nygard | |
| 5,481,784 | A * | 1/1996 | Sinaiko | 24/67.9 |
| 5,524,929 | A | 6/1996 | Emmel | |
| 5,524,998 | A | 6/1996 | Schwartz | |
| 5,571,617 | A | 11/1996 | Cooprider | |
| 5,744,207 | A | 4/1998 | Bartusiak | |
| 5,824,748 | A | 10/1998 | Kesti | |
| 5,870,802 | A | 2/1999 | Goldman | |
| 5,874,144 | A | 2/1999 | Kumar | |
| 5,876,817 | A | 3/1999 | Mathna | |
| 5,906,883 | A | 5/1999 | Blanc-Brude | |
| 6,149,304 | A | 11/2000 | Hamilton | |
| 6,352,766 | B1 | 3/2002 | Crandall | |
| 6,420,480 | B1 | 7/2002 | Ozdeger | |
| 6,858,285 | B1 | 2/2005 | Hamilton | |
| 6,911,243 | B2 | 6/2005 | Sher | |
| 7,040,051 | B2 | 5/2006 | Windorski | |
| 7,225,570 | B2 | 6/2007 | Windorski | |
| 7,326,453 | B2 | 2/2008 | Windorski | |
| D580,982 | S | 11/2008 | Lau | |
| D588,197 | S | 3/2009 | Lau | |
| 7,509,765 | B2 | 3/2009 | Flores | |
| D594,903 | S | 6/2009 | Lau | |
| D595,773 | S | 7/2009 | Lau | |
| 7,674,345 | B2 | 3/2010 | Graham | |
| 7,730,593 | B1 | 6/2010 | Juilly | |
| 7,793,449 | B2 | 9/2010 | Groch | |
| 7,849,622 | B2 | 12/2010 | Flores | |
| 7,857,127 | B2 | 12/2010 | Lau | |
| 8,074,325 | B2 | 12/2011 | Gerfast | |
| 8,397,410 | B1 * | 3/2013 | Lau | 40/666 |
| 2002/0179237 | A1 | 12/2002 | Inagaki | |
| 2005/0170174 | A1 | 8/2005 | Windorski | |
| 2005/0217078 | A1 * | 10/2005 | Groch et al. | 24/67.3 |
| 2005/0276971 | A1 | 12/2005 | Kitchin | |
| 2006/0130384 | A1 * | 6/2006 | Yosida | 40/666 |
| 2006/0188710 | A1 | 8/2006 | Windorski | |
| 2006/0210792 | A1 | 9/2006 | Windorski | |
| 2007/0067966 | A1 * | 3/2007 | Flores | 24/67.3 |
| 2007/0277417 | A1 * | 12/2007 | Babcock | 40/666 |
| 2008/0063842 | A1 | 3/2008 | Callinan | |
| 2008/0138591 | A1 | 6/2008 | Graham | |
| 2011/0239502 | A1 * | 10/2011 | Gladman | 40/541 |

FOREIGN PATENT DOCUMENTS

| | | |
|---|---|---|
| JP | 6171270 | 6/1994 |
| JP | 3101251 | 8/2000 |
| WO | WO 95/19023 | 7/1995 |
| WO | WO 2007/038286 | 4/2007 |
| WO | WO 2012/087994 | 6/2012 |
| WO | WO 2012/087995 | 6/2012 |
| WO | WO 2012/087996 | 6/2012 |
| WO | WO 2013/036475 | 3/2013 |

OTHER PUBLICATIONS

[Retrieved from the internet on Jul. 18, 2011] <http:/www.officemax.com/catalog/images/397x353/21730263i_02.jpg>; 1 page.

PCT/US2012/053597 International Search Report Oct. 31, 2012, 4 pgs.

* cited by examiner

PAPERCLIP TAB

CROSS REFERENCE TO RELATED APPLICATIONS

This is a national stage filing under 35 U.S.C. §371 of PCT/US2012/053597, filed Sep. 4, 2012, which claims the benefit of U.S. Provisional Application No. 61/531,840, filed Sep. 7, 2011, the disclosure of which is incorporated herein by reference in its entirety.

FIELD

The present disclosure generally relates to a paperclip tab for coupling to an object or for binding multiple articles or objects together while providing a tab or flag for identification and organization, and particularly, for coupling to an object, or plurality of objects with enhanced security.

BACKGROUND

In working with large stacks of documents, it can be desirable to categorize the documents or to flag a document that is of particular interest. Tabs or flags can be useful to categorize documents by signaling when one category ends and another begins or to highlight a page of particular importance. In addition to tabbing or flagging a page, it can be desirable to make notes on that page. However, depending on the importance of maintaining the original document, marking directly on the flagged page may not be desirable.

Some existing tabs or flags may allow for flagging and note-taking, but may not allow for binding the object, or plurality of objects, separately from other objects (e.g., documents) to adequately categorize such objects. As such, a tab or flag may need to be employed in conjunction with other articles or devices, such as paperclips, binder clips, elastic bands, or other suitable fasteners.

Some existing paperclips, paperclip assemblies, or paperclip tabs employ paperclips inserted through an opening in a sheet, such that the sheet can be coupled to an object with the paperclip. However, in such assemblies, the paperclip can slide in use relative to the sheet and/or the object to which the paperclip is coupled, such that the paperclip may easily fall from the object, losing any organization or notes that have been made. In addition, in some assemblies, the sheet can move relative to the paperclip and/or the object to which the paperclip is coupled, such that the sheet may not adequately provide the function of tabbing or flagging a page, for example, if the sheet has tipped relative to the object or the paperclip.

SUMMARY

The paperclip tabs of the present disclosure afford easy-to-use and attractive filing and organizing of various articles or objects, such as paper, documents, envelopes, files, or the like. The paperclip tabs can allow for facile re-arrangement or re-organization, and can provide secure binding of various articles together, while providing a writable surface and a tab or flag portion that extends beyond an edge of the group of articles for enhanced filing, organization, and retrieval of desired articles. Furthermore, the paperclip tabs of the present disclosure can be formed of a single sheet that includes a rear adhesive surface that is folded about one leg of a paperclip and adhered to itself to securely retain at least a portion of the paperclip. In addition, the paperclip tabs of the present disclosure can include a recessed adhesive that can be selectively activated and positioned to enhance the coupling between the paperclip tab and an object to which the paperclip tab is coupled. In some embodiments, the paperclip tabs of the present disclosure can be employed to bind various articles together, but can also be used to facilitate categorizing and/or retrieving the bound articles.

Some embodiments of the present disclosure provide a paperclip tab for coupling to an object. The paperclip tab can include a paperclip having a first leg and a second leg that are biased toward one another, such that the paperclip is configured to retain at least a portion of the object between the first leg and the second leg. The paperclip tab can further include a sheet having a front surface and a rear surface opposite the front surface. The sheet can further include a first portion; and a second portion positioned in overlapping relationship over at least a portion of the first portion with the rear surface of the first portion and the rear surface of the second portion facing each another, such that a pocket is formed between the first portion and the second portion, the pocket configured to retain the first leg of the paperclip. The paperclip tab can further include an adhesive positioned between the first portion and the second portion, such that at least a portion of the rear surface of the first portion is adhered to at least a portion of the rear surface of the second portion. The paperclip tab can further include a recessed adhesive zone on a back of the paperclip tab positioned to face the object when the paperclip tab is coupled to the object.

Some embodiments of the present disclosure provide a paperclip tab for coupling to an object. The paperclip tab can include a paperclip having a first leg and a second leg that are biased toward one another, such that the paperclip is configured to retain at least a portion of the object between the first leg and the second leg. The paperclip tab can further include a sheet comprising a front surface and a rear surface opposite the front surface, and further including an adhesive on the rear surface, the sheet folded to form a pocket between the rear surface of a first portion of the sheet and the rear surface of a second portion of the sheet, the first leg of the paperclip being positioned in the pocket. The paperclip tab can further include a recessed adhesive zone on a back of the paperclip tab, the recessed adhesive zone positioned to face the object when the paperclip tab is coupled to the object.

Some embodiments of the present disclosure provide a paperclip tab for coupling to an object. The paperclip tab can include a paperclip having a first leg and a second leg that are biased toward one another, such that the paperclip is configured to retain at least a portion of the object between the first leg and the second leg. The paperclip tab can further include a first sheet having a front surface, and a rear surface opposite the front surface, and a second sheet having a front surface, and a rear surface opposite the front surface, the second sheet positioned in overlapping relationship over a portion of the first sheet with the rear surface of the first sheet and the rear surface of the second sheet facing each another, such that a pocket is formed between the first sheet and the second sheet, the pocket configured to retain the first leg of the paperclip. The paperclip tab can further include an adhesive positioned between the first sheet and the second sheet, such that at least a portion of the rear surface of the first sheet is adhered to at least a portion of the rear surface of the second sheet. The paperclip tab can further include a recessed adhesive zone on a back of the paperclip tab positioned to face the object when the paperclip tab is coupled to the object.

Some embodiments of the present disclosure provide a method of making a paperclip tab. The paperclip tab can be configured to be coupled to an object. The method can include providing a paperclip having a first leg and a second leg that are biased toward one another, such that the paperclip is configured to retain at least a portion of the object between the first leg and the second leg. The method can further include providing a first sheet having a front surface, and a rear surface opposite the front surface. The method can further include providing a second sheet having a front surface, and a rear surface opposite the front surface. The method can further include positioning the second sheet between the first leg and the second leg of the paperclip, and adhering the rear surface of the first sheet and the rear surface of the second sheet together to form a pocket that is configured to retain the first leg of the paperclip between the first sheet and the second sheet; and providing a recessed adhesive zone on a back of the paperclip tab.

Other features and aspects of the present disclosure will become apparent by consideration of the detailed description and accompanying drawings.

DETAILED DESCRIPTION

Figure 1:
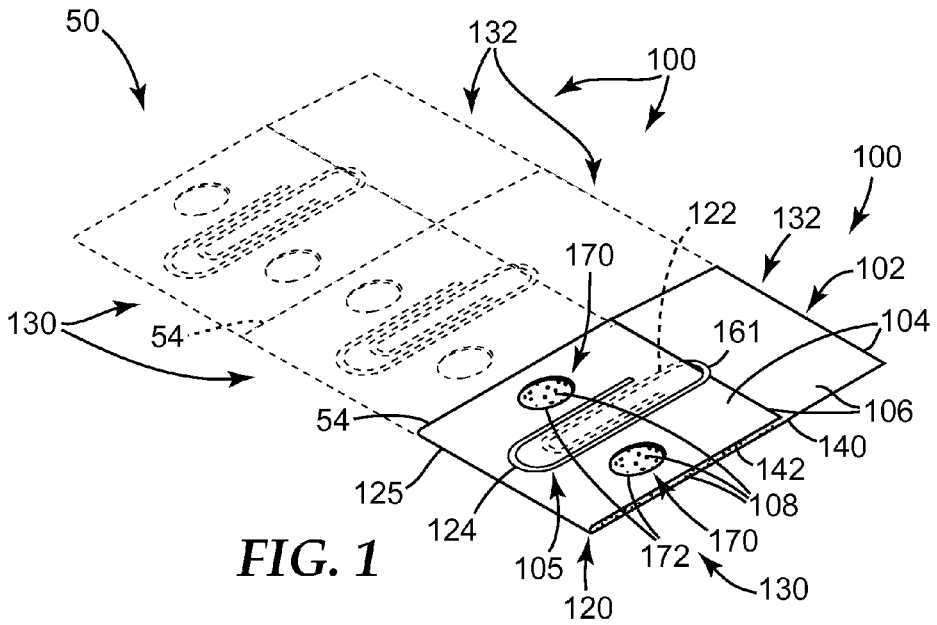
FIG. 1 is an assembled rear perspective view of a paperclip tab according to one embodiment of the present disclosure, showing the paperclip tab optionally as one of a plurality of paperclip tabs in a sheet assembly.

Before any embodiments of the present disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "supported," and "coupled" and variations thereof are used broadly and encompass both direct and indirect mountings, connections, supports, and couplings. Further, "connected" and "coupled" are not restricted to physical or mechanical connections or couplings. It is to be understood that other embodiments may be utilized, and structural or logical changes may be made without departing from the scope of the present disclosure. Furthermore, terms such as "front," "rear," "top," "bottom," "first," "second," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

The present disclosure generally relates to paperclip tabs, which, in some embodiments, can include a single sheet that includes a rear adhesive surface that is folded about a paperclip, such that two portions of the rear adhesive surface contact one another across the paperclip to house and retain a portion of the paperclip therein. In some embodiments, the two portions of the sheet can be separated by a fold, and can form a folded section. In some embodiments, one or more of the portions of the sheet can include an opening or cutaway zone formed therein, such that when the two portions are folded together over a portion of the paperclip, the adhesive on the rear surface of one portion is exposed across the opening in the other portion. In some embodiments, one or more portions of the sheet can include an adhesive positioned on its front surface adjacent an exposed portion of the paperclip to form a recessed adhesive that is recessed relative to the exposed portion of the paperclip. As a result, the paperclip tabs of the present disclosure can include a recessed adhesive zone, such that an object or article (e.g., a sheet of paper) can be further secured by the paperclip tab (e.g., in addition to forces exerted by the paperclip) by pressing one or both of the paperclip tab and the object adjacent the recessed adhesive zone into contact to activate the recessed adhesive zone. Because the adhesive is recessed, it is selectively activated in that it does not substantially bind to objects until desired, and until activated (e.g., pressed).

The paperclip tabs of the present disclosure can be used in a variety of applications, including but not limited to, tabbing one or more articles (e.g., for facile retrieval or identification), binding various articles together, filing, organizing, or combinations thereof. For example, in some embodiments, the paperclip tabs can be used to bind, file and/or organize sheets of paper, envelopes, bills, to-do lists, calendars, pages of a book (including magazines, catalogs, reference manuals, etc.), projects, recipe cards, newspapers or clippings thereof, other suitable articles or objects, or combinations thereof. In some embodiments, the paperclip tabs can be color-coded, for example, such that the paperclip tabs can be employed at one time, each paperclip tab designated for a different use, purpose, project, or the like.

Figure 2:
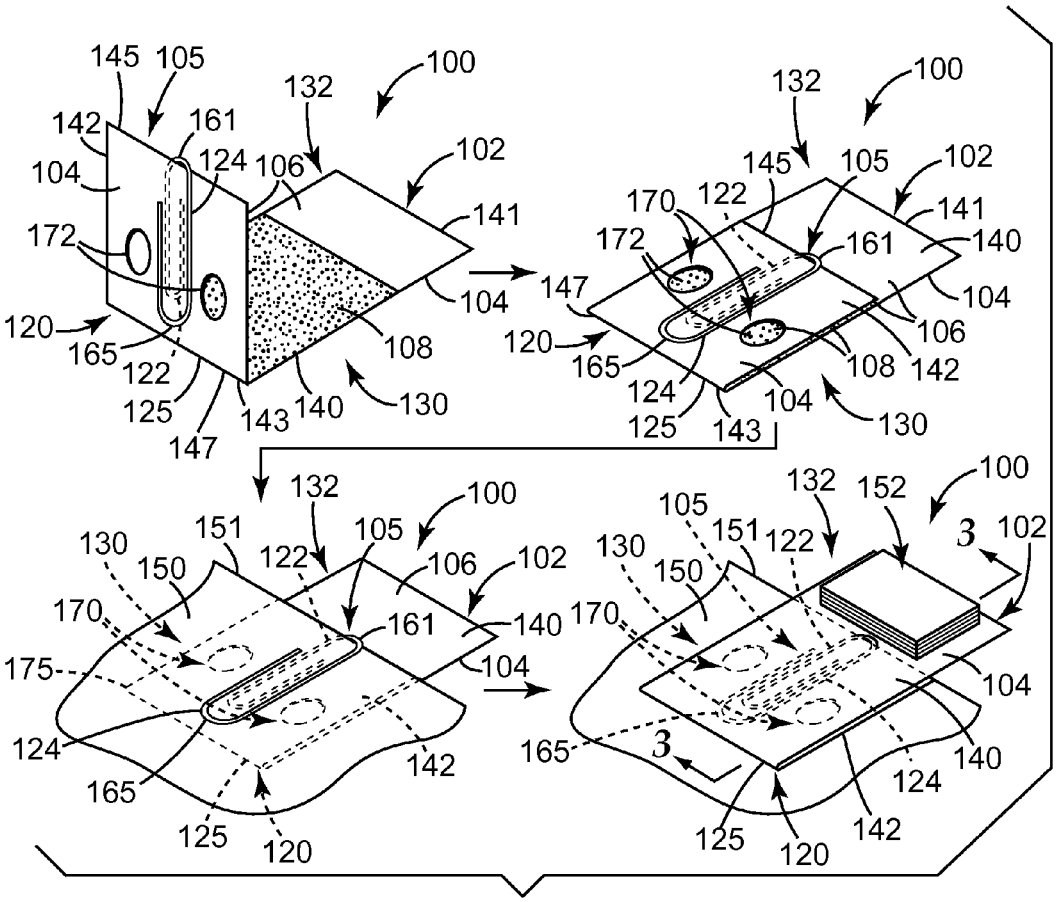
FIG. 2 shows a method of assembling and using the paperclip tab of FIG. 1, the final view showing a stack coupled to the paperclip tab.
Figure 3:
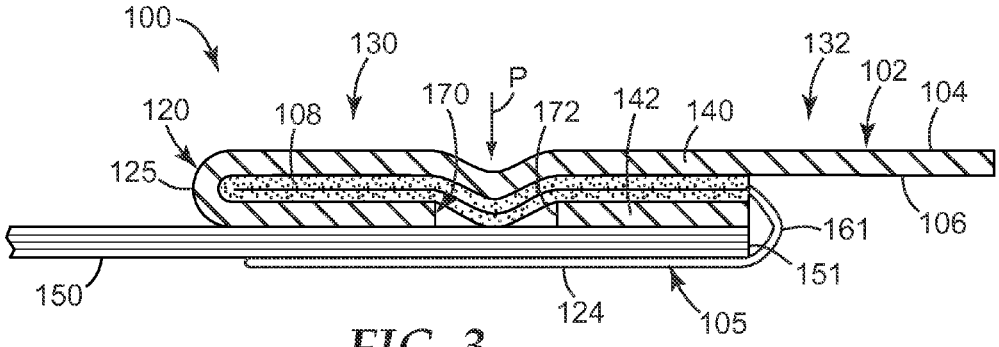
FIG. 3 is a side cross-sectional view of the paperclip tab of FIGS. 1-2, taken along line 3-3 of FIG. 2, with the stack removed for clarity.

FIGS. 1-3 illustrate a paperclip tab or paperclip flag 100 according to one embodiment of the present disclosure. FIGS. 1, 3 and portions of FIG. 2 show the paperclip tab 100 assembled, and the first view in FIG. 2 shows the paperclip tab 100 unassembled.

As shown in FIGS. 1-3, in some embodiments, the paperclip tab 100 can include a sheet (or substrate) 102 and a paperclip (or fastener or clip) 105. The sheet 102 can include a front surface 104, a rear surface 106, and an adhesive (e.g., a pressure-sensitive adhesive) 108 on the rear surface 106. In some embodiments, the adhesive 108 can be coextensive with the sheet 102 (e.g., with the rear surface 106 of the sheet 102). Furthermore, as shown, in some embodiments, the sheet 102 can include one or more openings or cutaway zones 172 formed therethrough so as to form one or more recessed adhesive areas, regions or zones 170. In addition, the paperclip tab 100 can include a folded section 120 formed in the sheet 102.

U.S. Patent Application No. 61/425,838 generally describes binding systems that employ folded sections and recessed adhesive zones, and is incorporated herein by reference in its entirety. U.S. Patent Application No. 61/531,875, filed Sep. 7, 2011, describes paperclip tabs employing recessed adhesive zones and extension portions for securely coupling to an object, and is incorporated herein by reference in its entirety. U.S. Patent Application No. 61/531,854, filed Sep. 7, 2011, describes recessed adhesive binding tabs, and is incorporated herein by reference in its entirety. U.S. Patent Application No. 61/531,833, filed Sep. 7, 2011, describes paperclip tabs, and is incorporated herein by reference in its entirety. U.S. Patent Application Nos. 61/531,887, 61/531,894, and 61/531,907, all filed Sep. 7, 2011, describe various binder clip tabs and elements thereof, each of which is incorporated herein by reference in its entirety.

The sheet 102 can be formed of a variety of materials, including, but not limited to, one or more of paper, cardstock, cardboard, plastic film, other suitable materials, or a combination or laminate thereof. In some embodiments, the front surface 104 of the sheet 102 can be colored (e.g., stained, coated, dyed, etc.) for an attractive appearance, for example, that affords high contrast between the paperclip tab 100 and articles to be bound, filed and/or organized by the paperclip tab 100. Furthermore, in some embodiments, at least the front surface 104 of the sheet 102 can be configured to receive (i.e., be receptive to) ink, dyes, print, toner, marks, or the like, such that at least the front surface 104 can be writable, printable, and/or stainable and can serve as a writing surface, a printing surface, or the like.

The paperclip 105 can include a first leg 122 and a second leg 124 that are biased toward one another to retain an object between the first leg 122 and the second leg 124. As shown, the sheet 102 can be wrapped around and secured to the first leg 122 of the paperclip 105, such that, in use, an object or article can be retained between the second leg 124 of the paperclip 105 and the sheet 102 (or a portion thereof). In the embodiment illustrated in FIGS. 1-3, the paperclip 105 has one leg that is shorter than the other, and the shorter leg is designated as the "first" leg 122, while the longer leg is designated as the "second" leg 124. However, it should be understood that the designation of the first and second legs 122 and 124 is by way of example only, and in some embodiments, the legs 122 and 124 of the paperclip 105 will be of equal length, or the longer leg can be referred to as the "first" leg 124, and the shorter leg can be referred to as the "second" leg 122. In addition, throughout the present disclosure, the portion of the paperclip 105 described as being retained or wrapped by the sheet 102 is referred to as the "first leg" 122; however, it should be understood that this portion of the paperclip 105 can instead be referred to as the "second leg" 124, and the designation is for clarity and simplicity only.

A variety of styles of paperclips can be employed that are suitable for retaining an object such as a sheet of paper, or a plurality of sheets of paper. The illustrated paperclip 105 is shown by way of example only, however, it should be understood that paperclips having a variety of shapes, sizes and configurations can be employed without departing from the spirit and scope of the present disclosure.

In addition, the paperclip 105 can be formed of a variety of materials, including metal (e.g., wire), plastic, coated metal, coated plastic, other suitably rigid and strong materials, or combinations thereof.

As shown, the sheet 102 can be folded into a folded section 120 that can be configured to be folded about the first leg 122 of the paperclip 105. In addition, the rear surface 106 of the sheet 102 can be adhered to itself around the first leg 122 of the paperclip 105 (see FIG. 2).

The paperclip tab 100 can further include a body portion (or body, or note portion) 130 and a tab portion (or tab, or flag, or flag portion) 132. The body portion 130 can include the paperclip 105 and at least a portion of the folded section 120. In some embodiments, the body portion 130 can generally be defined as the portion of the paperclip tab 100 that functions to couple the paperclip tab 100 to an object 150 (see the third view of FIG. 2). The body portion 130 can also, or instead, generally be defined as the portion of the paperclip tab 100 that sits adjacent the object 150, does not extend beyond an edge 151 of the object 150, and generally fits within the confines or edges of the object 150. The tab portion 132 can include a portion of the sheet 102, generally does not include the paperclip 105, and is configured to extend beyond the edge 151 of the object 150 to be easily visible and identifiable, particularly, when the object 150 is within a larger stack or pile of other objects (e.g., multiple stacks of paper stacked upon one another or positioned in a file). While the body portion 130 and the tab portion 132 are shown in FIGS. 1-3, it should be understood that some embodiments do not include the tab portion 132. In such embodiments, the paperclip tab 100 can still be used to enhance the coupling between the paperclip tab 100 and the object 150, and can also serve as a writable surface for note-taking, positioning of decals, etc.

In some embodiments, the folded section 120 of the paperclip tab 100 can be described as including a first portion 140 and a second portion 142 that are separated by a fold 125, and the second portion 142 can include one or more openings or cutaway zones 172, such when the sheet 102 is folded about the fold 125, the adhesive 108 is exposed across the one or more openings 172 and is recessed relative to the front surface 104 of the second portion 142 of the sheet 102 to form a recessed adhesive zone 170 on the second portion 142 of the sheet 102 that is positioned to face the object 150 when the paperclip tab 100 is coupled to the object 150.

However, in some embodiments, the paperclip tab 100 need not include any folds or folded sections, and rather can include separate portions of a sheet or separate sheets that have their own free ends but which are positioned in overlying relationship to retain at least a portion of the paperclip 105 therebetween and to provide at least the body portion 130, and optionally, the tab portion 132.

That is, with reference to FIG. 2, in some embodiments, the sheet 102 can be described as comprising a plurality of portions or sections positioned (e.g., folded) about the paperclip 105 (or multiple sheets 102 can be employed to include)

- a first portion, section or sheet 140 that extends from a first end 141 to a second end (or first fold) 143; and
- a second portion, section or sheet 142 that overlies a lower portion of the first portion 140 and extends from a first end 145 to a second end 147 in such a way that at least a portion of the rear surface 106 of the second portion 142 is adhered to at least a portion (e.g., a lower portion) of the rear surface 106 of the first portion 140.

Specifically, in such embodiments, the rear surface 106 of the first portion 140 (or at least the lower portion of the first portion 140) and the second portion 142 of the sheet 102 can be adhered together around the first leg 122 of the paperclip 105 to at least partially cover or envelop the first leg 122 of the paperclip 105 and to form a pocket 136 between the first portion 140 and the second portion 142 of the sheet 102 in which the first leg 122 of the paperclip 105 is retained.

As used herein, the term "end" is generally used to refer to the terminus of a portion or section, and may be defined by a physical end of the sheet 102, or a junction (e.g., as defined by a fold) with an adjacent portion or section of the sheet 102.

In the embodiment illustrated in FIGS. 1-3, the paperclip tab 100 includes both the body portion 130 and the tab portion 132, and the first portion 140 has a first length, and the second portion 142 has a second length that is less than the first length, such that the first portion 140 is longer than the second portion 142. Furthermore, the first end 141 of the first portion 140 is not aligned with the first end 145 of the second portion 142, but rather, the first portion 140 extends beyond the first end 145 of the second portion 142 to form the tab portion 132 of the paperclip tab 100.

In addition, in some embodiments, the second end 147 of the second portion 142 is not aligned with the second end 143 of the first portion 140 (see, e.g., FIGS. 5-8 and 10, described below). That is, in some embodiments, the first portion 140 can extend beyond the second end 147 of the second portion 142. In such embodiments, the adhesive 108 on the rear surface 106 of the first portion 140 can be exposed below the second end 147 of the second portion 142.

In the embodiment shown in FIGS. 1-3, the second end 143 of the first portion 140 and the second end 147 of the second portion 142 are not only aligned and coterminous, but they are actually formed of and defined by the same fold 125. However, as described above, this need not be the case. In embodiments employing separate portions of the sheet 102 (or separate sheets 102) as the first portion 140 and the second portion 142 of the paperclip tab 100, the adhesive 108 can be provided in a variety of locations and manners and can be described as simply being positioned or located between the first sheet (or the first portion) 140 and the second sheet (or the second portion) 142.

In some embodiments (e.g., in embodiments employing the tab portion 132), the adhesive 108 may not extend along the entire rear surface 106 of the sheet 102, and particularly, may not extend along the entire rear surface 106 of the first portion 140 of the sheet 102. In some embodiments, only a portion (e.g., a lower portion) of the first portion 140 of the sheet 102 includes the adhesive 108 on its rear surface 106. However, in some embodiments, a portion (e.g., a lower portion) of the first portion 140 as well as the second portion 142 includes the adhesive 108 on at least a portion of its rear surface 106. In embodiments such as the embodiment of FIGS. 1-3 where the one or more recessed adhesive zones 170 employ cutaway zones 172, the adhesive 108 can be positioned between the first portion 140 and the second portion 142, either on the first portion 140, or on the first portion 140 and the second portion 142, such that when the second portion 142 and the first portion 140 overlie one another, the adhesive 108 is exposed across the one or more cutaway zones 172 to form one or more recessed adhesive zones 170. Additionally, the adhesive 108 can extend along a greater area between the first portion 140 and the second portion 142 to secure the first portion 140 and the second portion 142 to one another and/or to retain a portion (e.g., the first leg 122) of the paperclip 105 in the pocket 136 formed between the first portion 140 and the second portion 142.

As shown, in some embodiments, the paperclip 105 can be positioned all the way onto the second portion 142 and into the pocket 136, such that the first end 145 of the second portion 142 is positioned adjacent a first (or top) end 161 of the paperclip 105. Such a configuration can allow the full capacity of the paperclip 105 to be used in binding the object 150 (i.e., such that the object 150 can be inserted all the way up to the first end 161 of the paperclip 105 (see the third and fourth views of FIG. 2). Such a configuration can further enhance the retention of the paperclip 105 within the pocket 136, and can ultimately enhance the coupling between the paperclip tab 100 and the object 150.

In the embodiment illustrated in FIGS. 1-3, the second portion 142 of the sheet 102 is sized to accommodate all of the second leg 124 of the paperclip 105, such that the paperclip 105 does not extend beyond the second end 147 of the second portion 142, and such that the paperclip 105 is not visible from the front of the paperclip tab 100 (see the last view of FIG. 2). In the embodiment illustrated in FIGS. 1-3, the second portion 142 is even sized such that a gap exists between the second end 147 of the second portion 142 and a second (or bottom) end 165 of the paperclip 105. However, it should be understood that this need not be the case, and in some embodiments, the paperclip 105 can be coupled to the sheet 102 in such a way that the paperclip 105 is visible from the front of the paperclip tab 100. In addition, in the embodiment of FIGS. 1-3, the second end 165 of the paperclip 105 is provided by the second leg 124; however, in some embodiments, the second end 165 of the paperclip 105 can be provided by the first leg 122 of the paperclip 205.

In embodiments such as the embodiment shown in FIGS. 1-3, the paperclip 105, the lower portion of the first portion 140, and the second portion 142 can form at least a portion of the body portion 130 of the paperclip tab 100, and the upper portion of the first portion 140 can form the tab portion 132 of the paperclip tab 100.

As described above, in some embodiments, as shown in FIGS. 1-3, the sheet 102 can include a single sheet that can be folded upon itself and upon the paperclip 105. In such embodiments, the above description of the portions or sections 140, 142 of the sheet 102 still applies, and one or more of the "ends" 141, 143, 145, 147 (i.e., the second ends 143, 145) can refer to a fold in the sheet 102 (i.e., the fold 125).

As shown in FIGS. 1-3, in some embodiments, the front surface 104 of the first portion 140 can form the front of the paperclip tab 100, and the front surface 104 of the second portion 142 can form the back of the paperclip tab 100 (or a portion thereof).

As mentioned above, in some embodiments, the sheet 102 (e.g., the front surface 104) can be receptive to inks, dyes, or the like. Additionally or alternatively, in some embodiments, one or both of the body portion 130 and the tab portion 132 can include a multi-layer stack or tablet 152 (see, e.g., the fourth view of FIG. 2) of sheets, which can be receptive to inks, dyes, print, toner, marks, or the like, such that the sheets are writable, printable, and/or stainable and can serve as a writing surface, a printing surface, or the like. In some embodiments, the stack of sheets can be coupled together using an adhesive or glue that functions as a binding edge, or each of the sheets can be adhesive-backed (e.g., adhesive-backed paper), such that each sheet can be adhered to an underlying sheet (or the front surface 104 of the sheet 102) with an adhesive (e.g., a pressure-sensitive adhesive, such as repositionable adhesives described in greater detail below) on its rear surface. That is, in some embodiments, the stack 152 can include a stack of POST-IT® notes, available from 3M Company, (St. Paul, Minn.). In such embodiments, the paperclip tab 100 can be reused until the stack 152 is depleted, or in embodiments in which the front surface 104 is also writable, printable and/or stainable, the sheet 102 can be written or printed upon when the stack 152 is depleted. Alternatively or additionally, in some embodiments, the stack 152 can be replaced by a new stack 152 on the same sheet 102.

The stack 152 is shown in FIG. 2 but is removed from the other figures for clarity and simplicity. The stack 152 is shown by way of example only as being coupled to a front of the paperclip tab 100, and particularly, to a front of the tab portion 132 of the paperclip tab 100; however, it should be understood that in some embodiments, what is referred to in the figure descriptions as the front of the paperclip tab 100 can instead be the back or rear, and vice versa. In addition, while the stack 152 is shown as being coupled to the front of the paperclip tab 100, it should be understood that the stack 152 can instead be coupled to the rear of the paperclip tab 100, and particularly, can be coupled to whichever face or surface of the paperclip tab 100 that would face a user in use.

In addition, the stack 152 is shown by way of example only as being located in the tab portion 132 of the paperclip tab 100; however, it should be understood that the stack 152 can instead be positioned entirely on the body portion 130 (e.g., in embodiments that do not employ a tab portion 132), or on a combination of the body portion 130 and the tab portion 132. In some embodiments in which the stack 152 does not entirely obscure a front of the paperclip tab 100, at least the portion of the exposed front of the paperclip tab 100 can be writable, printable, and/or stainable. Alternatively, or additionally, the binder clip tab 100 can include a plurality of stacks 152.

As shown in FIG. 1, the stack 152 can be coupled to the front surface 104 of the sheet 102 and can be positioned to face away from the object (e.g., the object 150 of FIG. 2) to which the paperclip tab 100 is coupled. As such, the stack 152 can be coupled to the front surface 104 of the sheet 102 adjacent the first leg 122 of the paperclip, for example, when the stack 152 is coupled to at least the body portion 130 of the paperclip tab 100.

In addition, the stack 152 is shown as comprising generally rectangular or square-shaped sheets; however, it should be understood that any size or shape of sheets can be used in the stack 152. In addition, any commercially-available type of POST-IT® notes can be employed, including those of different shapes, colors, types of writing surfaces, and types of adhesive.

In some embodiments, the sheet 102 can be sized to form a suitable writing surface, either in the body portion 130, the tab portion 132, or both. In some embodiments, the front surface 104 of the sheet 102 (e.g., of the first portion 140 that forms the front of the paperclip tab 100) can include lines for making notes. The sheet 102 can have any size, shape or color, and while the overall shape (and width) of the body portion 130 and the tab portion 132 are shown as being essentially the same in the illustrated embodiments, in some embodiments, the body portion 130 can have a different shape or size than the tab portion 132. The tab portion 132 may also be of another color than the rest of the paperclip tab 100. Also, in some embodiments, one or both of the body portion 130 and the tab portion 132 can be preprinted with indicia, or have lines preprinted thereon to facilitate making notes on the paperclip tab 100.

That is, the sheet 102 can be shaped and sized to form a body portion 130 and tab portion 132 of any desired shape and size. In some embodiments, the sheet 102 can be much wider than the paperclip 105 to provide a large writing surface (e.g., on the body portion 130), to accommodate a large stack 152, multiple stacks 152, or the like.

Furthermore, in the embodiment illustrated in FIGS. 1-3, the sheet 102 is shown as being long and narrow and similar in shape and overall dimensions to that of the paperclip 105. However, this need not be the case. Rather, the sheet 102 can be shaped and sized to form a body portion 130 and a tab portion 132 of any desired shape and size. In some embodiments, the sheet 102 (and therefore, the body portion 130 and/or the tab portion 132) can be much wider than the paperclip 105 to provide a large writing surface on one or both of the body portion 130 and the tab portion 132, to accommodate a large stack 152, or the like.

The adhesive 108 employed in the paperclip tab 100 can be a pressure-sensitive adhesive. In some embodiments, the adhesive 108 can provide good adhesion to a surface, while also being removable under moderate force without leaving a residue (e.g., removable and/or repositionable pressure-sensitive adhesives). However, in some embodiments, the adhesive can be an adhesive that binds more permanently, or adheres well, to itself.

Examples of suitable materials for the adhesive 108 include one or more adhesives based on (meth)acrylates, urethanes, silicones, epoxies, rubber based adhesives (including natural rubber, polyisoprene, polyisobutylene, and butyl rubber, block copolymers, and thermoplastic rubbers), and combinations thereof.

Examples of suitable (meth)acrylates include polymers of alkyl acrylate monomers such as methyl methacrylate, ethyl methacrylate, n-butyl methacrylate, methyl acrylate, ethyl acrylate, n-butyl acrylate, iso-octyl acrylate, iso-nonyl acrylate, 2-ethyl-hexyl acrylate, decyl acrylate, dodecyl acrylate, n-butyl acrylate, hexyl acrylate, and combinations thereof. Examples of commercially available block copolymers include those available under the trade designation "KRATON G-1657" from Kraton Polymers, Westhollow, Tex.

As described above, in some embodiments, the adhesive 108 can include a removable and/or repositionable pressure-sensitive adhesive. An adhesive is considered to be "removable," if after final application to an intended substrate, the sheet 102 (or the paperclip tab 100) can be removed at the end of the intended life of the article at a rate in excess of 7.62 meters/hour (25 feet/hour) by hand with the optional use of heat without damage to either the surface to which it is coupled (e.g., adhered portions of the sheet 102). In some embodiments, the removable pressure-sensitive adhesive has a 180 degree peel strength (from a sheet of 400-gauge Mylar D PET film, available from the E.I. du Pont de Nemours and Company, Wilmington, Del.) of less than 8 N/cm, and more particularly, less than 6 N/cm.

The term "repositionable" generally refers to the ability to be, at least initially, repeatedly adhered to and removed from a surface without substantial loss of adhesion capability. In some embodiments, the repositionable pressure-sensitive adhesive has a 180 degree peel strength, at least initially, of less than about 2 N/cm, in some embodiments, less than about 1 N/cm, and in some embodiments, less than about 0.1 N/cm, when peeled from a sheet of 400-gauge Mylar D PET film, available from the E.I. du Pont de Nemours and Company, Wilmington, Del.

Examples of suitable removable and repositionable pressure-sensitive adhesives include those described in Hobbs et al., U.S. Publication No. 2005/0249791 and Cooprider et al., U.S. Pat. No. 5,571,617, both of which are incorporated herein by reference; and adhesives based on solid inherently tacky, elastomeric microspheres, such as those disclosed in Silver, U.S. Pat. No. 3,691,140, Merrill et al., U.S. Pat. No. 3,857,731, and Baker et al., U.S. Pat. No. 4,166,152; all of which are incorporated herein by reference. Other removable and repositionable pressure-sensitive adhesives that can be employed in the present disclosure include those employing the composite pressure-sensitive adhesive microspheres disclosed in Kesti et al., U.S. Pat. No. 5,824,748, which is incorporated herein by reference.

However, in some embodiments, a repositionable adhesive can be repositionable when adhered to a variety of surfaces (e.g., mounting surfaces), but not necessarily when it is adhered to itself (e.g., in the back-to-back configurations shown in the figures). That is, in some embodiments, the adhesive 108 can have a greater affinity for itself than for other surfaces (e.g., the front surface 104 of the sheet 102).

In some embodiments, the adhesive 108 can be substantially smooth. In some embodiments, the adhesive 108 can be textured or include a topography. A topography can be beneficial for bleeding air out from beneath the sheet 102 as it is applied to a surface, thereby reducing the amount of trapped air pockets beneath the sheet 102. Examples of suitable topographies are discussed in Sher et al., U.S. Pat. No. 6,911,243, which is incorporated herein by reference.

In some embodiments, the thickness of the adhesive 108 can be at least about 10 micrometers, in some embodiments, at least about 20 micrometers, and in some embodiments, at least about 50 micrometers. In some embodiments, the thickness of the adhesive 108 can be no greater than about 300 micrometers, in some embodiments, no greater than about 200 micrometers, and in some embodiments, no greater than about 100 micrometers.

The recessed adhesive zone(s) 170 of the paperclip tab 100 will now be described in greater detail. FIG. 3 shows a cross-sectional side view of the paperclip tab 100, taken through one recessed adhesive zone 170. Examples of various types of recessed adhesive zones that can be employed in the paperclip tabs of the present disclosure employing recessed adhesive zones are described in U.S. Pat. No. 7,326,453 (Windorski), the disclosure of which is incorporated herein by reference in its entirety.

In some embodiments, the recessed adhesive zones 170 can be "selectively activated" to enhance the coupling between the paperclip tab 100 and the object 150. The recessed adhesive zones 170 can be selectively activated because the adhesive 108 is exposed across the one or more openings 172 and recessed from the front surface 104 of the sheet 102. For example, with reference to FIG. 2, when the folded section 120 is collapsed and the rear surface 106 of the second portion 142 is adhered to the rear surface 106 of the first portion 140, the adhesive 108 is exposed across the openings 172 and recessed from the front surface 104 of the second portion 142 of the sheet 102, forming the recessed adhesive zones 170 in the second portion 142.

The openings 172 shown in FIGS. 1-3 include two full, circular openings 172, such that the material of the sheet 102 is present on all sides of the opening 172. However, it should be understood that a variety of openings 172 can be employed in which no sheet material is present on at least one side of the opening 172. For example, in some embodiments, the opening 172 can open to an edge or side of the sheet 102, such that sheet material is not present on all sides of the opening 172, and can form more of a "cutaway zone." In some embodiments, the sheet 102 is formed of paper, and the opening 172 can be referred to as a "paperless zone." A variety of shapes of openings 172 can be employed in the paperclip tab 100, including, but not limited to, triangles, rectangles, squares, ovals, oblong-shaped openings, semi-circles, trapezoids, polygons, waves, grooves, notches, scallops (e.g., scalloped edges), other suitable shapes, or combinations thereof. In addition, the two openings 172 are shown by way of example only, and it should be understood that as few as one recessed adhesive zone 170 and as many as desired can be employed.

Because the adhesive 108 is recessed from the front surface 104 of the sheet 102 in the one or more recessed adhesive zones 170, the adhesive 108 does not adhere to a surface or object (e.g., the object 150) positioned adjacent the front surface 104 of the second portion 142 of the sheet 102 in the area of the recessed adhesive zone 170 until the recessed adhesive 108 is activated, e.g., until the recessed adhesive zone 170 is pressed toward that surface or object. For example, the first portion 140 of the sheet 102 can be pressed to press the adhesive 108 through the opening 172 and into contact with the surface or object.

The recessed adhesive zones 170 of the present disclosure can also be referred to as "selectively activated" adhesive areas or zones. Because the adhesive 108 is recessed from the front surface 104 of the second portion 142 of the sheet 102 in the one or more recessed adhesive zones 170, the adhesive 108 does not adhere to a surface or object positioned adjacent the front surface 104 of the sheet 102 until the recessed adhesive 108 is activated, e.g., until the recessed adhesive zone 170 is pressed toward that surface or object. For example, the folded section 120 (i.e., body portion 130, first portion 140, front of the paperclip tab 100, etc.) can be pressed adjacent one or more recessed adhesive zones 170 to press the adhesive 108 through the opening 172 and into contact with the surface or object.

In some embodiments, the adhesive 108 can be recessed from the front surface 104 of the sheet 102 at least partially because the height of the adhesive 108 is less than the thickness of the sheet 102. That is, the thickness of the sheet 102 can be sufficient to space or separate the exposed adhesive 108 on the rear surface 106 of the first portion 140 from another surface or object contacting the front surface 104 of the second portion 142. In some embodiments, the sheet 102 can have a thickness of at least about 0.05 mm, in some embodiments, at least about 0.07 mm, in some embodiments, at least about 0.1 mm, and in some embodiments, at least about 0.25 mm.

In some embodiments, the adhesive 108 can be alternatively or additionally recessed relative to the paperclip 105 (e.g., the second leg 124 of the paperclip 105), particularly in embodiments in which the adhesive 108 is located adjacent the paperclip 105 so as to be recessed from a rearmost surface of the paperclip 105 and of the paperclip tab 100. In the embodiment of FIGS. 1-3, the adhesive 108 is recessed both relative to the front surface 104 of the sheet 102 (i.e., relative to the front surface 104 of the second portion 142) and relative to the paperclip 105 (i.e., the second leg 124 of the paperclip 105). That is, depending on how closely the recessed adhesive zones 170 are located to the paperclip 105, the thickness of the paperclip 105 can additionally recess the adhesive 108 on the rear surface 106 of the first portion 140 from the front surface 104 of the second portion 142 (and from a back of the paperclip tab 100).

As a result, the paperclip tab 100 can be handled and moved across another surface, such as a sheet of paper, without adhering thereto via the exposed adhesive 108, or without adhering thereto until the recessed adhesive zone 170 is activated. This non-stick feature can also be dependent, to some degree, upon the fact that the sheet 102 has sufficient strength and/or rigidity so as not to sag appreciably (if at all) into any of the openings 172 across which it extends, even though it is unsupported across the cutaway openings 172. The size of the openings 172 can also be controlled to control the "stickyness" of the corresponding recessed adhesive zone 170. For example, in some embodiments, relatively small (e.g., no greater than 1 cm across) openings 172 can be employed, and in such embodiments, a larger number of openings 172 can be employed. The ability of the paperclip tab 100 to adhere to various articles or objects can be dictated by the total or overall surface area of exposed and recessed adhesive 108, which can be controlled by controlling the size and/or number of recessed adhesive zones 170.

Activating the recessed adhesive 108 can be manual, such as by pressing against the first portion 140 of the sheet 102 with the fingers, palm, or hand of a user, for example, in a direction toward the second portion 142 of the sheet 102, generally denoted as P (see FIG. 3). While the adhesive 108 is activated to be adhered to another surface, the sheet 102 may deform on its front surface 104, although the deformation may not be visually or tactilely appreciable to the user.

The direction of pressure P in FIG. 3 is shown by way of example only; however, it should be understood that pressure P can instead be applied in a direction generally opposite the illustrated direction of P in FIG. 3. For example, the object 150 can be pressed in a direction generally opposite that of P until the object 150 (and/or the sheet 102) flexes and/or deforms enough to allow the adhesive 108 to contact and adhere to the object 150. In some embodiments, a combination of pressures in opposing directions and deformations of both the sheet 102 and the object 150 (e.g., the top sheet of paper in a stack of sheets of paper) can be employed to activate the adhesive 108.

Such dual opposing pressure can also be applied by pressing or pinching a front of the paperclip tab 100 and a back of the object 150 (e.g., simultaneously) to activate the one or more recessed adhesive zones 170 located on the second portion 142 of the sheet 102 to further enhance the coupling of the paperclip tab 100 to the object 150.

In some embodiments, the front surface 104 of the sheet 102 and/or the rear surface 106 of the sheet 102 can be configured such that the rear surface 106 adheres (or adheres well) to the rear surface 106 of another portion of the rear surface 106 of the sheet 102, but does not adhere (or does not adhere well) to the front surface 104 of the sheet 102. That is, in some embodiments, the adhesive 108 and/or the front surface 104 of the sheet 102 can be configured such that the adhesive 108 does not adhere (or does not adhere well) to the front surface 104 of another portion (e.g., an adjacent portion) of the sheet 102, even when activated (e.g., when the sheet 102 is pressed adjacent a recessed adhesive zone 170). That is, in some embodiments, the front surface 104 of the sheet 102 and the adhesive 108 can be configured such that the adhesive 108 has a greater affinity for itself (e.g., on another portion of the rear surface 106) than for the front surface 104 of the sheet 102. As such, the adhesive 108 can be configured so as not to unnecessarily wear out or lose its tackiness by adhering to other portions of the recessed paperclip tab 100 when not in use to bind various articles of interest.

The phrase "adheres well" can generally refer to the adhesive 108 having a 90 degree peel strength, at least initially, of at least about 500 g, in some embodiments, at least about 800 g, and in some embodiments, at least about 1000 g (1 kg), when a 1-inch-(2.54 cm)-wide strip of the sheet 102 having the adhesive 108 on its rear surface 106 is peeled from another portion of the rear surface 106 of the sheet 102, having the adhesive 108 thereon (i.e., when the adhesive 108 is peeled from itself).

The phrase "does not adhere well" can generally refer to the adhesive 108 having a 90 degree peel strength, at least initially, of less than about 50 g, in some embodiments, less than about 30 g, and in some embodiments, less than about 20 g, when a 1-inch-(2.54 cm)-wide strip of the sheet 102 having the adhesive 108 on its rear surface 106 is peeled from another portion of the front surface 104 of the sheet 102.

For example, in some embodiments, an adhesive comprising composite pressure-sensitive adhesive microspheres can be employed, such as the microspheres and adhesives described in U.S. Pat. No. 5,824,748, which is incorporated herein by reference in its entirety. In addition, or alternatively, in some embodiments, the front surface 104 of the sheet 102 can include a release coating in order to achieve minimal, or lack of, affinity between the adhesive 108 and the front surface 104 of the sheet 102. That is, in some embodiments, the front surface 104 of the sheet 102 can function as a release (or releasable) liner for the adhesive 108 of the sheet 102. In addition, or alternatively, the front surface 104 of the sheet 102 can be glazed to enhance slidability, e.g., with itself. Examples of release coatings or low adhesion backsize (LAB) materials that can be applied to the front surface 104 of the sheet 102 can be found in U.S. Pat. Nos. 5,744,207, 5,874,144, 6,352,766, and 6,420,480, which are incorporated herein by reference in their entirety. For example, adhesive POST-IT® note products (e.g., the sheet or paper, as well as the adhesives) available under the trade designation "SUPER STICKY" (3M Company, St. Paul, Minn.), can be employed as the sheet 102 and the adhesive 108 on the rear surface 106 of the sheet 102.

As shown in FIG. 1, in some embodiments of the present disclosure, a plurality of paperclip tabs 100 can be provided in a sheet assembly 50 separated from an adjacent paperclip tab 100 by at least one of a fold and a perforation 54. By way of example only, in some embodiments, the sheet assembly 50 can be formed by coupling a plurality of paperclips 105 to one end of one large sheet 102, folding the large sheet 102 over a plurality of paperclips 105, and then the sheet 102 can be folded and/or perforated to form folds and/or perforations 54 separating each paperclip tab 100. Three paperclip tabs 100 are shown in the sheet assembly 50 by way of example only; however it should be understood that the sheet 102 can be sized to accommodate as few as one paperclip 105 (e.g., see FIGS. 1-3) and as many as desired.

In the embodiment illustrated in FIG. 1, the sheet assembly 50 can include a side-to-side configuration, such that at least one side of the paperclip tab 100 (e.g., at least one side of the tab portion 132 and/or the body portion 130 of each of the plurality of paperclip tabs 100) can be separated from a side of an adjacent paperclip tab 100 by a fold and/or perforation 54.

In some embodiments, the sheet assembly 50 can be folded at each fold or perforation 54, either in the same direction as the previous fold 54 to essentially form a roll, or in alternating fashion (e.g., in a zig-zag fashion) to form a stack. In other embodiments, the sheet assembly 50 can be perforated to allow for facile separation of the paperclip tabs 100, and then the sheet assembly 50 can be rolled along its length (e.g., from left to right in FIG. 1), and can be provided in a rolled configuration. Such a roll can be accessed from a dispenser, and as many paperclip tabs 100 as desired can be removed at a given time by separating the sheet assembly 50 along one or more perforations 54.

The sheet assembly 50 is shown as including a plurality of the paperclip tab 100 of FIGS. 1-3; however, it should be understood that other configurations of the paperclip tab of the present disclosure can instead be provided in the sheet assembly 50, and in some embodiments, a variety of paperclips and/or paperclip tabs can be employed in one sheet assembly 50. However, in some embodiments, manufacturing of the sheet assembly 50 can be facilitated by having all of the paperclip tabs formed therein being the same type of paperclip tab.

With reference to FIG. 2, methods of making a paperclip tab 100 according to one embodiment of the present disclosure can generally include providing a paperclip 105 having a first leg 122 and a second leg 124 that are biased toward one another, and providing a sheet 102 having a front surface 104 and a rear surface 106 and further including an adhesive 108 on the rear surface 106. The sheet 102 can have a first portion 140 and a second portion 142, or separate sheets can be employed. In some embodiments, the first portion (or sheet) 140 can be longer than the second portion (or sheet) 142, such that an upper portion of the first portion (or sheet) 140 can form a tab portion 132 of the paperclip tab 100. The method can further include positioning the second portion (or sheet) 142 between the first leg 122 and the second leg 124 of the paperclip 105. In some embodiments, this can include inserting a first end 145 of the second portion (or sheet) 142 all the way into the paperclip 105, i.e., adjacent the first end 161 of the paperclip 105.

The method can further include positioning the rear surface 106 of the first portion 140 and the rear surface 106 of the second portion 142 together to form the pocket 136 therebetween that is configured to retain the first leg 122 of the paperclip 105. The paperclip 105, the second portion 142, and at least a portion of the first portion 140 can form a body portion 130 of the paperclip tab 100. The adhesive 108 can be provided between the rear surface 106 of the first portion 140 and the rear surface 106 of the second portion 142 of the sheet 102, such that when the rear surfaces 106 of the first portion 140 and the second portion 142 are positioned together, at least the first portion 140 and the second portion 142 are adhered together (i.e., back-to-back). The front surface 104 of the first portion 140 can form a front of the paperclip tab 100, and the front surface 104 of the second portion 142 can form a back of the paperclip tab 100 that will face a surface, article or object 150 to which the paperclip tab 100 will be coupled. The second portion 142 (and the back of the paperclip tab 100) can also include a recessed adhesive zone 170.

In some embodiments, as shown in FIG. 2, the second portion 142 can include one or more cutaway zones 172, such that when the rear surface 106 of the second portion 142 is adhered to the rear surface 106 of the first portion 140, the adhesive 108 therebetween is exposed across the cutaway zone(s) 172 and recessed relative to the front surface 104 of the second portion 142, and optionally additionally recessed relative to the paperclip 105 (e.g., relative to the exposed second leg 124 of the paperclip 105). Such recessed adhesive zone(s) 170 can be selectively activated to adhere to the object 150 when desired to enhance the coupling between the paperclip tab 100 and the object 150. In some embodiments, however, the front surface of the second portion 142 can include an exposed adhesive that is positioned relative to the paperclip 105 (e.g., relative to the second leg 124 of the paperclip 105), such that the adhesive is recessed relative to the paperclip 105 and can be selectively activated. Furthermore, in some embodiments, a portion of the rear surface 106 of the first portion 140 can be exposed on the back of the paperclip tab 100 and be recessed relative to the paperclip 105 (e.g., relative to the second leg 124 of the paperclip 105) and/or the second portion 142 of the sheet 102, such that the adhesive 108 can be selectively activated.

As further shown in FIG. 2, the paperclip tab 100 can be coupled to the object 150 by positioning (e.g., sliding) the object 150 between the exposed second leg 124 of the paperclip 105 and the front surface 104 of the second portion 142. In some embodiments, the edge 151 can be positioned all the way into the paperclip 105, e.g., such that the edge 151 is positioned adjacent the first end 161 of the paperclip 105, as shown. The third and fourth views of FIG. 2 show the object 150 coupled to the paperclip tab 100 the third view shows the paperclip tab 100 from the back (e.g., the paperclip side, or the second portion side) and shows the back side of the object 150, and the fourth view shows the paperclip tab 100 from the front (e.g., the first portion side) and shows the front side of the object 150. The recessed adhesive zones 170 can then be activated (e.g., pressed) toward the object 150 (or vice versa, or a combination thereof) to further secure the paperclip tab 100 to the object 150 (see FIG. 3).

In some embodiments, the adhesive (e.g., the adhesive 108 between the first portion 140 and the second portion 142 or an additional adhesive on the front surface 104 of the second portion 142) may be positioned in such a way it at least partially interferes with coupling the paperclip tab 100 to the object 150 via the paperclip 105, or otherwise interferes with the function of the paperclip 105. In such embodiments, the paperclip tab 100 can be coupled to the object 150 by leading with a portion or corner (e.g., a lower corner 175; see third view of FIG. 2) of the paperclip tab 100, rather than the bottom edge of the paperclip tab 100 (e.g., the fold 125, the second end 143 of the first portion 142, the second end 147 of the second portion 142, etc.) when coupling (e.g., sliding) the object 150 between the second leg 124 of the paperclip 105 and the front surface 104 of the second portion 142. That is, in some embodiments, the paperclip tab 100 may need to be oriented at an angle with respect to the edge 151 of the object 150 as the paperclip tab 100 is coupled to the object 150, particularly, at the beginning of the process of coupling the paperclip tab 100 to the object 150 and moving (e.g., sliding) the paperclip tab 100 and the object 150 relative to one another.

The above described methods of making a paperclip tab of the present disclosure and methods of applying a paperclip tab of the present disclosure to an object can also be used to make and apply any of the paperclip tabs disclosed herein. Additional exemplary embodiments of paperclip tabs of the present disclosure will now be described.

Figure 4:
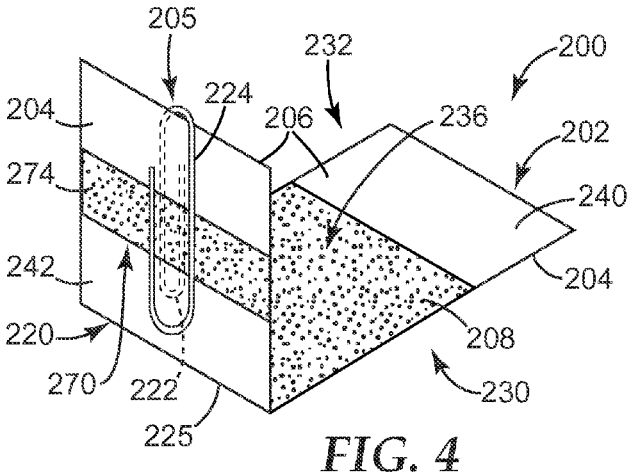
FIG. 4 is an unassembled rear perspective view of a paperclip tab according to another embodiment of the present disclosure.

FIG. 4 illustrates a paperclip tab 200 according to another embodiment of the present disclosure, wherein like numerals represent like elements. The paperclip tab 200 shares many of the same elements and features described above with reference to the illustrated embodiment of FIGS. 1-3. Accordingly, elements and features of the embodiment of FIG. 4 corresponding to elements and features in the illustrated embodiment of FIGS. 1-3 are provided with the same reference numerals in the 200 series. Reference is made to the description above accompanying FIGS. 1-3 for a more complete description of the features and elements (and alternatives to such features and elements) of the embodiment illustrated in FIG. 4. Any of the features described with respect to the embodiment of FIGS. 1-3 can equally be applied to the embodiment of FIG. 4.

As shown in FIG. 4, the paperclip tab 200 can include a sheet (or substrate) 202 and a paperclip (or fastener or clip) 205. The sheet 202 can include a front surface 204, a rear surface 206, and an adhesive (e.g., a pressure-sensitive adhesive) 208 on the rear surface 206. The sheet 202 can include a first portion 240 and a second portion 242 that can either be separated by a fold 225 (as shown), or can be separate sheets with separate first and second ends, as described above with respect to FIGS. 1-3. When the first portion 240 and the second portion 242 are separated by the fold 225, the paperclip tab 200 can be described as including a folded section 220. The paperclip tab 200 can further include a recessed adhesive zone 270 on the front surface 204 of the second portion 242, such that the recessed adhesive zone 270 is on the back of the paperclip tab 200 and facing an object to which the paperclip tab 200 can be coupled. The paperclip 205 can include a first leg 222 and a second leg 224 that can be biased toward one another to retain an object therebetween. The first leg 222 can be retained in a pocket 236 formed between the first portion 240 and the second portion 242 when the rear surfaces 206 of the first portion 240 and the second portion 242 are coupled together. Furthermore, as shown in FIG. 4, the paperclip tab 200 can include a body portion 230 and a tab portion 232. However, in some embodiments, the paperclip tab 200 may not include the tab portion 232.

The descriptions above with respect to the folded section, portions, ends, legs, and the like of the sheet 102, paperclip 105, and/or the paperclip tab 100 of FIGS. 1-3 can equally be applied and used to describe the sheet 202, the paperclip 205, and the paperclip tab 200 of FIG. 4. As a result, for simplicity, such descriptions are not repeated here. However, one main difference between the paperclip tab 100 of FIGS. 1-3 and the paperclip tab 200 of FIG. 4 is that the second portion 242 does not include any cutaway zones or openings formed therethrough. Rather, the second portion 242 includes an adhesive 274 on its front surface 204 that is exposed on the front surface 204, but is recessed by the paperclip 205, and particularly, by the (exposed) second leg 224 of the paperclip 205. As such, the adhesive 274 is recessed from the rearmost surface of the paperclip 205 and the paperclip tab 200, such that the adhesive 274 can be selectively activated when desired by pressing it into contact with an object to which the paperclip tab 200 is coupled, when desired. The adhesive 274 can have the same composition as that of the adhesive 208 located between the rear surfaces 206 of the first portion 240 and the second portion 242, or the recessed adhesive 274 can have a different composition than the adhesive 208. Either way, the descriptions above regarding the various materials and compositions of the adhesive 108 of FIGS. 1-3 can be applied to either the adhesive 208 or the recessed adhesive 274.

The paperclip tab 200 is shown as including a rectangular strip of the adhesive 274 that is positioned such that adhesive 274 will be present on both sides of the second leg 224 of the paperclip 205 when the paperclip 205 is positioned on the second portion 242. However, this shape and location of the adhesive 274 is shown by way of example only, and it should be understood that any size, shape and location of the adhesive 274 can be employed that is positioned relative to the second leg 224 of the paperclip 205 so as to function as a selectively-activatable recessed adhesive zone 270 when the paperclip 205 is coupled to the sheet 202.

As described above, sheet 202 (e.g., the front surface 204 of the sheet 202) can be writable, printable and/or stainable. Additionally or alternatively, the front of the paperclip tab 200 (e.g., the front surface 204 of the first portion 240) can include a multi-layer stack, such as the stack 152 described above with respect to FIG. 2, which can be used for note-taking or adhering stickers or decals.

As shown in FIG. 4, the sheet 202 includes the first portion 240 and the second portion 242 that are separated by a fold 225 that forms a bottom end of the paperclip tab 200. As a result, the paperclip tab 200 can also be provided as a plurality of paperclip tabs 200 in a sheet assembly in which the paperclip tabs 200 are joined side-by-side. However, in some embodiments, the paperclip tab of the present disclosure can instead include a fold that forms a side of the paperclip tab. Such an embodiment will now be described with respect to FIGS. 5-8.

FIGS. 5-8 illustrate a paperclip tab 300 according to another embodiment of the present disclosure, wherein like numerals represent like elements. The paperclip tab 300 shares many of the same elements and features described above with reference to the illustrated embodiments of FIGS. 1-4. Accordingly, elements and features of the embodiment of FIGS. 5-8 corresponding to elements and features in the illustrated embodiments of FIGS. 1-4 are provided with the same reference numerals in the 300 series. Reference is made to the description above accompanying FIGS. 1-4 for a more complete description of the features and elements (and alternatives to such features and elements) of the embodiment illustrated in FIGS. 5-8. Any of the features described with respect to the embodiments of FIGS. 1-4 can equally be applied to the embodiment of FIGS. 5-8.

As shown in FIGS. 5-8, the paperclip tab 300 can include a sheet (or substrate) 302 and a paperclip (or fastener or clip) 305. The sheet 302 can include a front surface 304, a rear surface 306, and an adhesive (e.g., a pressure-sensitive adhesive) 308 on the rear surface 306. The sheet 302 can include a first portion 340 and a second portion 342 that can either be separated by a fold 325 (as shown), or can be separate sheets with separate first and second ends, as described above with respect to FIGS. 1-3. When the first portion 340 and the second portion 342 are separated by the fold 325, the paperclip tab 300 can be described as including a folded section 320 (see FIG. 6). The paperclip tab 300 can further include a recessed adhesive zone 370 on the back of the paperclip tab 300 and facing an object to which the paperclip tab 300 can be coupled. The paperclip 305 can include a first leg 322 and a second leg 324 that can be biased toward one another to retain an object therebetween. The first leg 322 can be retained in a pocket 336 formed between the first portion 340 and the second portion 342 when the rear surfaces 306 of the first portion 340 and the second portion 342 are coupled together. Furthermore, as shown, the paperclip tab 300 can include a body portion 330 and a tab portion 332. However, in some embodiments, the paperclip tab 300 may not include the tab portion 332.

The descriptions above with respect to the folded section, portions, ends, legs, and the like of the sheet 102, paperclip 105, and/or the paperclip tab 100 of FIGS. 1-3 can equally be applied and used to describe the sheet 302, the paperclip 305, and the paperclip tab 300 of FIGS. 5-8. As a result, for simplicity, such descriptions are not repeated here. However, one main difference between the paperclip tab 100 of FIGS. 1-3 and the paperclip tab 300 of FIGS. 5-8 is that the second portion 342 does not include any cutaway zones or openings formed therethrough. Rather, the first portion 340 includes a second end 343 that extends beyond a second end 347 of the second portion 342, such that a lower portion of the first portion 340 is exposed to the back of the paperclip tab 300. Furthermore, as shown, the exposed rear surface 306 of the first portion 240 can include the adhesive 308, which can be recessed by the paperclip 305, and particularly, by the (exposed) second leg 324 of the paperclip 305. The adhesive 308 can also be recessed relative to the second portion 342, and particularly, relative to the front surface 304 of the second portion 342. As such, the adhesive 308 is recessed from the rearmost surface of the paperclip 305 and the paperclip tab 300, such that the adhesive 308 adjacent the second end 343 of the first portion 340 can be selectively activated when desired by pressing it into contact with an object to which the paperclip tab 300 is coupled, when desired. The portion of the adhesive 308 on the rear surface 306 of the first portion 340 that is exposed and recessed relative to the second portion 342 and/or the paperclip 305 can have the same composition as that of the rest of the adhesive 308 located between the rear surfaces 306 of the first portion 340 and the second portion 342, or the recessed adhesive 308 can have a different composition than the remainder of the adhesive 308. Either way, the descriptions above regarding the various materials and compositions of the adhesive 108 of FIGS. 1-3 can be applied to either portion of the adhesive 308.

Figure 5:
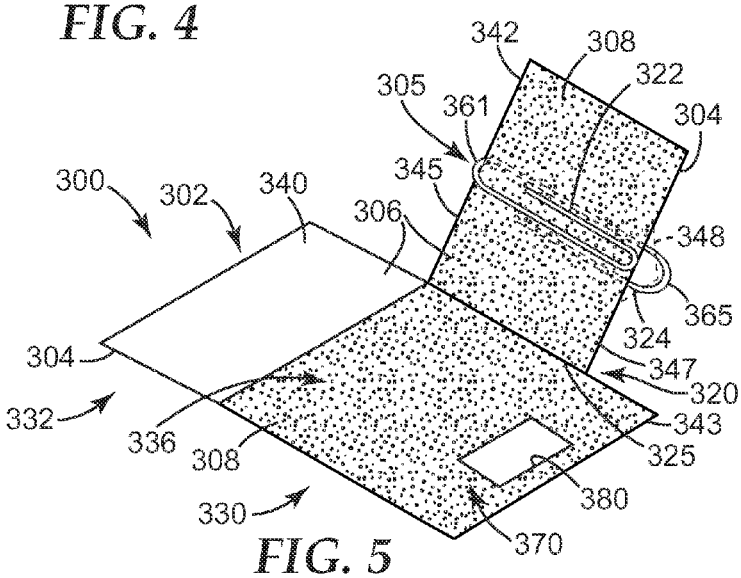
FIG. 5 is an unassembled rear perspective view of a paperclip tab according to another embodiment of the present disclosure.
Figure 6:
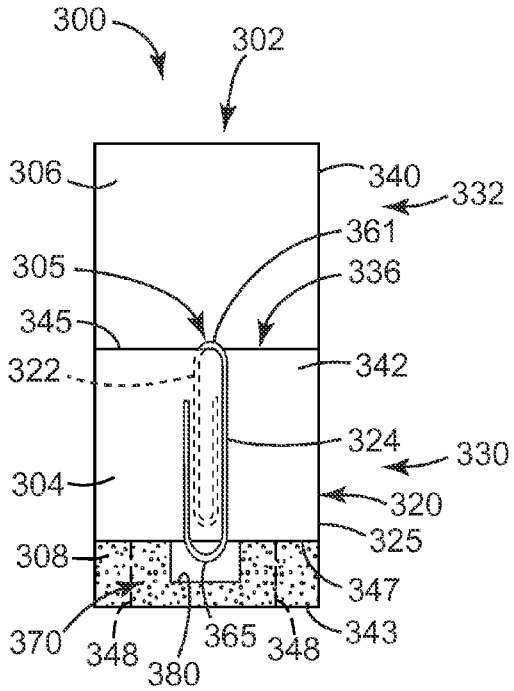
FIG. 6 is a rear plan view of the paperclip tab of FIG. 5.

The adhesive 308 on the rear surface 306 of the first portion 340 is shown in FIG. 5 as extending from a location coterminous with a first end 345 of the second portion 342 (i.e., when the first portion 340 and the second portion 342 are collapsed and coupled together) to the second end 343 of the first portion 340. In addition, the adhesive 308 is shown as extending from the first end 345 of the second portion 342 to the second end 347 of the second portion 342. However, this need not necessarily be the case, as long as a sufficient amount of adhesive 308 is present between the first portion 340 and the second portion 342 to retain the paperclip 305 in the pocket 336 and to couple the first portion 340 and the second portion 342 together, and as long as adhesive 308 is present adjacent the second end 343 of the first portion 340 (and optionally adjacent the paperclip 305, as shown) to form the recessed adhesive zone 370.

As shown, in some embodiments, the paperclip tab 300 can further include an opening 380 formed through at least the first portion 340 that can function as a viewing window for a user to see a bottom (or second) end 365 of the paperclip 305 from the front of the paperclip tab 300, particularly when the first end 345 of the second portion 342 is inserted all the way to a top (or first) end 361 of the paperclip 305. Such an opening 380 can cue a user as to how to use the paperclip tab 300, as well as to the location of the paperclip 305 behind the first portion 340 to aid in coupling the paperclip tab 300 to an object 350 (see FIG. 8). In such embodiments, it can be advantageous if the first leg 322 of the paperclip 305 that is retained between the first portion 340 and the second portion 342 is shorter than the exposed second leg 324 of the paperclip 305, so that the second leg 324 can more easily grip an edge 351 (see FIG. 8) of the object 350 when coupling, and can be viewed from the front of the paperclip tab 300 via the opening 380. While the opening 380 can provide some advantages, it should be understood that in some embodiments, the opening 380 is not provided. One advantage in embodiments not employing the opening 380 is that the adhesive 308 forming the recessed adhesive zone 370 can completely surround the bottom end 365 of the paperclip 305.

In addition, in some embodiments, the opening 380 can be exploited on the front of the paperclip 300, for example, by illustrating a smiley face, where the opening 380 can provide the mouth or smile of the smiley face.

In some embodiments, the adhesive 308 on the exposed lower portion of the first portion 340 can inhibit coupling the second leg 324 of the paperclip 305 to the object 350. As such, the above technique of leading with a corner of the paperclip tab 300 (i.e., orienting the paperclip tab 300 at an angle with respect to the edge 350 of the object 300) can be employed when coupling the paperclip tab 300 to the object 350. In some embodiments, the second portion 342 can include one or more wings or extensions 348 (see FIGS. 5 and 6) that extend beyond the second end 347 and cover a portion of the exposed adhesive 308 on the rear surface 306 of the first portion 340 (see FIG. 6). Alternatively or additionally, in some embodiments, the extension 348 can be centrally located relative to the position of the paperclip 305, such that the extension 348 can be located to assist coupling the second leg 324 of the paperclip 305 to the object 350 (see FIG. 5).

The adhesive 308 adjacent the second end 343 of the first portion 340 is shown as extending all the way across the rear surface 306 of the exposed lower portion of the first portion 340 (except for in the location of the opening 380). However, this need not be the case, as long as the adhesive 308 is located so as to be recessed relative to a rearmost surface of the paperclip tab 300, such that the adhesive 308 can be slid over surfaces without adhering, and can be activated when desired. In addition, in some embodiments, multiple areas of adhesive 308 can be present on the exposed lower portion of the first portion 340, such that more than one recessed adhesive zone 370 is present on the back of the paperclip tab 300. Any of the additional details and configurations (and alternatives thereof) described above with respect to the recessed adhesive zones 170 of FIGS. 1-3 can equally be applied to the recessed adhesive zone 370 of FIGS. 5-8.

Figure 8:
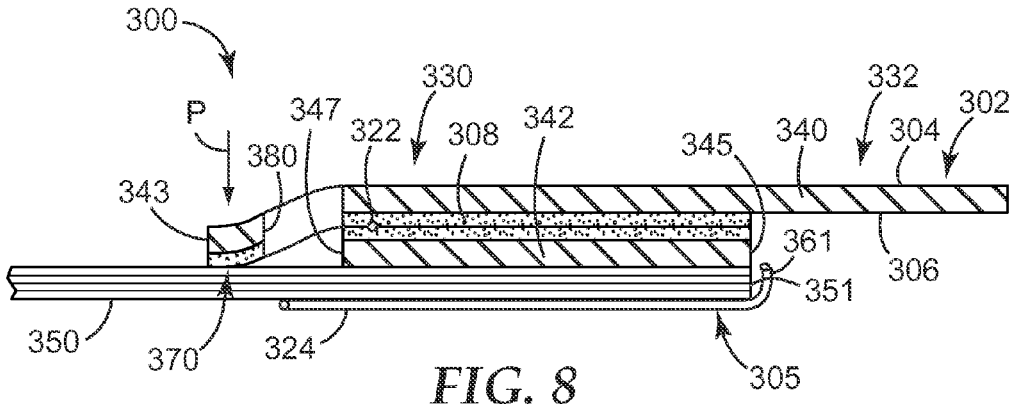
FIG. 8 is a side cross-sectional view of the paperclip tab of FIGS. 5-7, taken along line 8-8 of FIG. 7.

As shown in FIG. 8, activating the recessed adhesive 308 can be manual, such as by pressing against the first portion 340 of the sheet 302 with the fingers, palm, or hand of a user, for example, in a direction toward the object 350, generally denoted as P (see FIG. 8). While the adhesive 308 is activated to be adhered to another surface, the sheet 302 (e.g., the first portion 340 of the sheet 302) may deform on its front surface 304, as shown in FIG. 8, although the deformation may not be visually or tactilely appreciable to the user.

The direction of pressure P in FIG. 8 is shown by way of example only; however, it should be understood that pressure P can instead be applied in a direction generally opposite the illustrated direction of P in FIG. 8. For example, the object 350 can be pressed in a direction generally opposite that of P until the object 350 (and/or the sheet 302) flexes and/or deforms enough to allow the adhesive 308 to contact and adhere to the object 350. In some embodiments, a combination of pressures in opposing directions and deformations of both the sheet 302 and the object 350 (e.g., the top sheet of paper in a stack of sheets of paper) can be employed to activate the adhesive 308.

As described above, sheet 302 (e.g., the front surface 304 of the sheet 302) can be writable, printable and/or stainable. Additionally or alternatively, the front of the paperclip tab 300 (e.g., the front surface 304 of the first portion 340) can include a multi-layer stack, such as the stack 152 described above with respect to FIG. 2, which can be used for note-taking or adhering stickers or decals.

Figure 7:
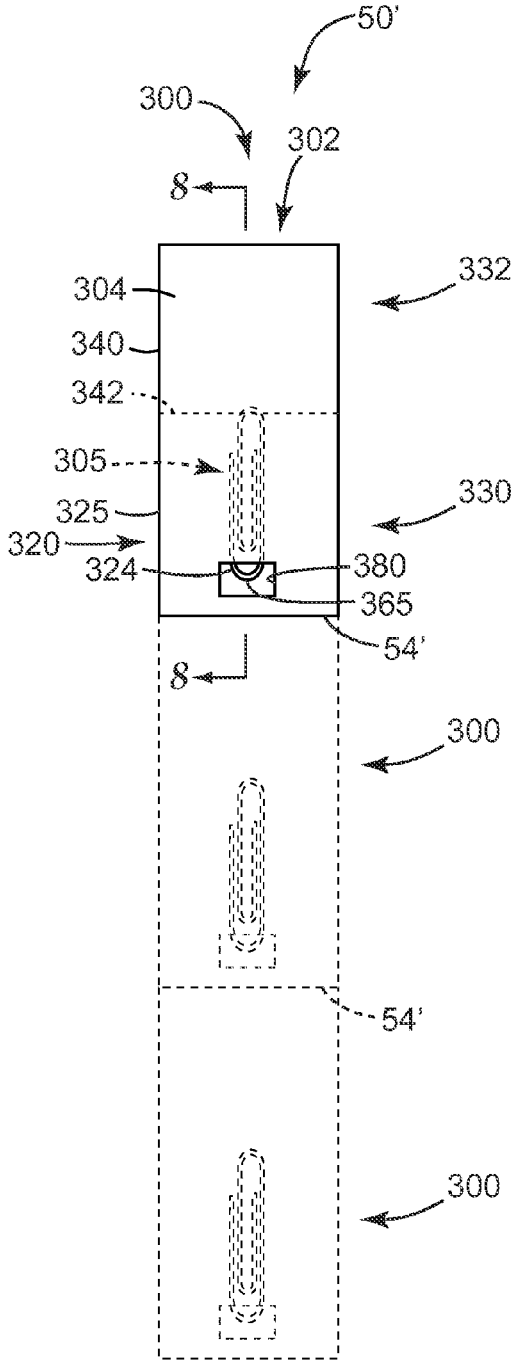
FIG. 7 is a front plan view of the paperclip tab of FIGS. 5-6, showing the paperclip tab optionally as one of a plurality of paperclip tabs in a sheet assembly.

As shown in FIG. 5, the sheet 302 includes the first portion 340 and the second portion 342 that are separated by a fold 325 that forms a side of the paperclip tab 300. As a result, as shown in FIG. 7, the paperclip tab 300 can also be provided as a plurality of paperclip tabs 300 in a sheet assembly 50' in which the paperclip tabs 300 are joined end-to-end, and each paperclip tab 300 is separated from an adjacent paperclip tab 300 by at least one of a fold and a perforation 54'. As described above, such a sheet assembly 50' can also be provided in a rolled or stacked configuration.

Figure 9:
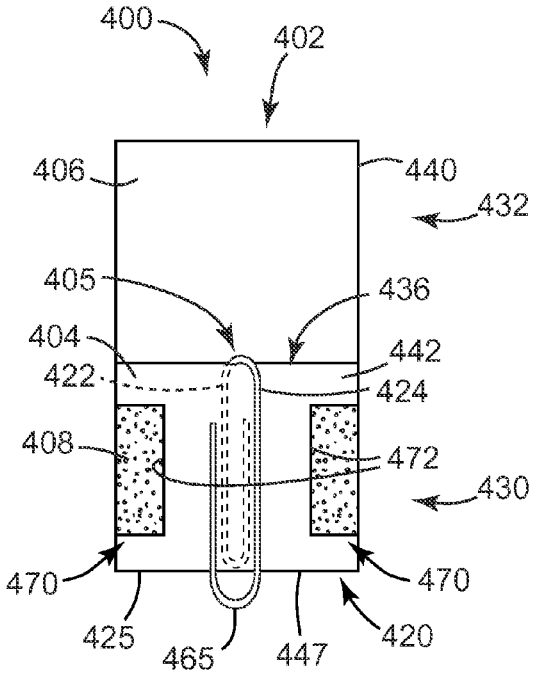
FIG. 9 is a rear plan view of a paperclip tab according to another embodiment of the present disclosure.

FIG. 9 illustrates a paperclip tab 400 according to another embodiment of the present disclosure, wherein like numerals represent like elements. The paperclip tab 400 shares many of the same elements and features described above with reference to the illustrated embodiments of FIGS. 1-8. Accordingly, elements and features of the embodiment of FIG. 9 corresponding to elements and features in the illustrated embodiments of FIGS. 1-8 are provided with the same reference numerals in the 400 series. Reference is made to the description above accompanying FIGS. 1-8 for a more complete description of the features and elements (and alternatives to such features and elements) of the embodiment illustrated in FIG. 9. Any of the features described with respect to the embodiments of FIGS. 1-8 can equally be applied to the embodiment of FIG. 9.

As shown in FIG. 9, the paperclip tab 400 can include a sheet (or substrate) 402 and a paperclip (or fastener or clip) 405. The sheet 402 can include a front surface 404, a rear surface 406, and an adhesive (e.g., a pressure-sensitive adhesive) 408 on the rear surface 406. The sheet 402 can include a first portion 440 and a second portion 442 that can either be separated by a fold 425 (as shown), or can be separate sheets with separate first and second ends, as described above with respect to FIGS. 1-3. When the first portion 440 and the second portion 442 are separated by the fold 425, the paperclip tab 400 can be described as including a folded section 420. The paperclip tab 400 can further include one or more recessed adhesive zones 470 on the front surface 404 of the second portion 442 formed by cutaway zones 472 formed through the second portion 442, such that the recessed adhesive zone 470 is on the back of the paperclip tab 400 and facing an object to which the paperclip tab 400 can be coupled. The paperclip 405 can include a first leg 422 and a second leg 424 that can be biased toward one another to retain an object therebetween. The first leg 422 can be retained in a pocket 436 formed between the first portion 440 and the second portion 442 when the rear surfaces 406 of the first portion 440 and the second portion 442 are coupled together. Furthermore, as shown in FIG. 9, the paperclip tab 400 can include a body portion 430 and a tab portion 432. However, in some embodiments, the paperclip tab 400 may not include the tab portion 432.

The descriptions above with respect to the folded section, portions, ends, legs, and the like of the sheet 102, paperclip 105, and/or the paperclip tab 100 of FIGS. 1-3 can equally be applied and used to describe the sheet 402, the paperclip 405, and the paperclip tab 400 of FIG. 9. As a result, for simplicity, such descriptions are not repeated here. However, the main differences between the paperclip tab 100 of FIGS. 1-3 and the paperclip tab 400 of FIG. 9 are the shape and position of the cutaway zones 472 forming the recessed adhesive zones 470 of the paperclip tab 400 of FIG. 9, and the position of a bottom end 465 of the paperclip 405 relative to a second end 447 of the second portion 442. Particularly, the cutaway zones 472 open to the sides (e.g., side edges) of the second portion 442 rather than being fully contained within the second portion 442, and the cutaway zones 472 are rectangular in shape. However, the recessed adhesive zones 470 of the paperclip tab 400 still function essentially the same as those of the paperclip tab 100 of FIGS. 1-3. The recessed adhesive zones 470 are recessed relative to the front surface 404 of the second portion 442 as well as to the paperclip 405 (e.g., the second leg 424 of the paperclip 405). Furthermore, the bottom end 465 of the paperclip 405 extends beyond the second end 447 of the second portion 442, such that it is visible from the front of the paperclip tab 400. As described above with respect to the opening 380 of FIGS. 5-8, such a configuration that allows a portion of the paperclip 405 to be visible from the front of the paperclip tab 400 can cue a user as to how to use the paperclip tab 400, and to the location of the paperclip 405, e.g., relative to the sheet 402.

The fold 425 is shown as forming an end of the paperclip tab 400, similar to the paperclip tab 100 of FIGS. 1-3. However, it should be understood that the fold 425 can instead form a side of the paperclip tab 400, similar to the paperclip tab 300 of FIGS. 5-8. Alternatively, the first portion 440 and the second portion 442 can be separate sheets that are coupled back-to-back.

Figure 10:
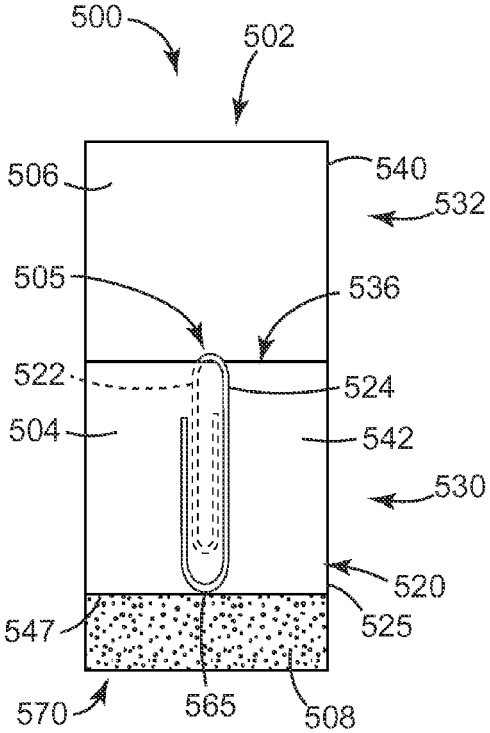
FIG. 10 is a rear plan view of a paperclip tab according to another embodiment of the present disclosure.

FIG. 10 illustrates a paperclip tab 500 according to another embodiment of the present disclosure, wherein like numerals represent like elements. The paperclip tab 500 shares many of the same elements and features described above with reference to the illustrated embodiments of FIGS. 1-9. Accordingly, elements and features of the embodiment of FIG. 10 corresponding to elements and features in the illustrated embodiments of FIGS. 1-9 are provided with the same reference numerals in the 500 series. Reference is made to the description above accompanying FIGS. 1-9 for a more complete description of the features and elements (and alternatives to such features and elements) of the embodiment illustrated in FIG. 10. Any of the features described with respect to the embodiments of FIGS. 1-9 can equally be applied to the embodiment of FIG. 10.

As shown in FIG. 10, the paperclip tab 500 can include a sheet (or substrate) 502 and a paperclip (or fastener or clip) 505. The sheet 502 can include a front surface 504, a rear surface 506, and an adhesive (e.g., a pressure-sensitive adhesive) 508 on the rear surface 506. The sheet 502 can include a first portion 540 and a second portion 542 that can either be separated by a fold 525 (as shown), or can be separate sheets with separate first and second ends, as described above with respect to FIGS. 1-3. When the first portion 540 and the second portion 542 are separated by the fold 525, the paperclip tab 500 can be described as including a folded section 520. The paperclip tab 500 can further include one or more recessed adhesive zones 570 on the back of the paperclip tab 500 and facing an object to which the paperclip tab 500 can be coupled. The paperclip 505 can include a first leg 522 and a second leg 524 that can be biased toward one another to retain an object therebetween. The first leg 522 can be retained in a pocket 536 formed between the first portion 540 and the second portion 542 when the rear surfaces 506 of the first portion 540 and the second portion 542 are coupled together. Furthermore, as shown in FIG. 10, the paperclip tab 500 can include a body portion 530 and a tab portion 532. However, in some embodiments, the paperclip tab 500 may not include the tab portion 532.

The descriptions above with respect to the folded section, portions, ends, legs, and the like of the sheet 102, paperclip 105, and/or the paperclip tab 100 of FIGS. 1-3 can equally be applied and used to describe the sheet 502, the paperclip 505, and the paperclip tab 500 of FIG. 10. As a result, for simplicity, such descriptions are not repeated here. In addition, the paperclip tab 500 is substantially similar to the paperclip tab 300 of FIGS. 5-8, however, the main differences between the paperclip tab 300 of FIGS. 5-8 and the paperclip tab 500 of FIG. 10 are that, in the paperclip tab 500 of FIG. 10, the paperclip 505 is fully contained within the second portion 542, such that a bottom end 565 of the paperclip 505 does not extend beyond a second end 547 of the second portion 542; and the first portion 540 does not include an opening formed therethrough. As such, the recessed adhesive zone 570 of the paperclip tab 500 includes an exposed lower portion of the first portion 540, and neither the paperclip 505 nor any opening is present in this region. The exposed adhesive 508 on the lower portion of the first portion 540 is recessed relative to the front surface 504 of the second portion 542, as well as being recessed relative to the paperclip 505 (e.g., the second leg 524 of the paperclip 505).

The fold 525 is shown as forming a side of the paperclip tab 500, similar to the paperclip tab 300 of FIGS. 5-8. As such, the paperclip tab 500 can also be provided in a sheet assembly in which the paperclip tabs are connected end-to-end, similar to the sheet assembly 50' shown in FIG. 7.

In the embodiments illustrated in the figures and described herein, the terms "first portion," "second portion," "first end," "second end," "first leg," "second leg," and the like, are used for clarity and illustration only. However, it should be understood that the "first portion" of the sheet can instead be the "second portion," etc., and that these terms are in no way intended to be limiting. For example, in some embodiments, the first leg 122, 222, 322, 422, 522 of the paperclip tab 100, 200, 300, 400, 500 can instead be referred to as the "second leg" 122, 222, 322, 422, 522, etc.

In addition, each embodiment shown in the figures is illustrated as a separate embodiment for clarity in illustrating a variety of features of the paperclip tabs of the present disclosure. However, it should be understood that any combination of elements and features of any of the embodiments illustrated in the figures and described herein can be employed in the paperclip tabs of the present disclosure.

The following embodiments are intended to be illustrative of the present disclosure and not limiting.

EMBODIMENTS

1. A paperclip tab for coupling to an object, the paperclip tab comprising:

a paperclip having a first leg and a second leg that are biased toward one another, such that the paperclip is configured to retain at least a portion of the object between the first leg and the second leg;

a sheet having a front surface and a rear surface opposite the front surface, the sheet further including a first portion, and a second portion positioned in overlapping relationship over at least a portion of the first portion with the rear surface of the first portion and the rear surface of the second portion facing each another, such that a pocket is formed between the first portion and the second portion, the pocket configured to retain the first leg of the paperclip;

an adhesive positioned between the first portion and the second portion, such that at least a portion of the rear surface of the first portion is adhered to at least a portion of the rear surface of the second portion; and a recessed adhesive zone on a back of the paperclip tab positioned to face the object when the paperclip tab is coupled to the object.

2. The paperclip tab of embodiment 1, wherein the adhesive is provided on at least the rear surface of the first portion.

3. The paperclip tab of embodiment 1 or 2, wherein the adhesive is provided on the rear surface of the first portion and the rear surface of the second portion.

4. The paperclip tab of any of embodiments 1-3, wherein the first portion and the second portion are formed from the same sheet and are separated by a fold, the fold forming at least a portion of an end or a side of the paperclip tab.

5. A paperclip tab for coupling to an object, the paperclip tab comprising:

a paperclip having a first leg and a second leg that are biased toward one another, such that the paperclip is configured to retain at least a portion of the object between the first leg and the second leg;

a sheet comprising a front surface and a rear surface opposite the front surface, and further including an adhesive on the rear surface, the sheet folded to form a pocket between the rear surface of a first portion of the sheet and the rear surface of a second portion of the sheet, the first leg of the paperclip being positioned in the pocket; and a recessed adhesive zone on a back of the paperclip tab, the recessed adhesive zone positioned to face the object when the paperclip tab is coupled to the object.

6. The paperclip tab of embodiment 5, wherein the fold forms at least a portion of an end or a side of the paperclip tab.

7. The paperclip tab of any of embodiments 1-6, wherein the recessed adhesive zone is on the second portion of the sheet.

8. The paperclip tab of any of embodiments 1-7, wherein the recessed adhesive zone is on the first portion of the sheet.

9. The paperclip tab of any of embodiments 1-8, wherein the first portion has a first length, wherein the second portion has a second length, and wherein the second length is less than the first length.

10. The paperclip tab of any of embodiments 1-9, wherein the first portion includes an upper portion that extends beyond a first end of the second portion and a first end of the paperclip.

11. The paperclip tab of any of embodiments 1-10, wherein the front surface of the first portion forms a front of the paperclip tab configured to face a user when the paperclip tab is in use.

12. The paperclip tab of any of embodiments 1-11, wherein the front surface of the second portion forms a back of the paperclip tab configured to face the object when the paperclip tab is coupled to the object.

13. The paperclip tab of any of embodiments 1-12, wherein the paperclip tab further comprises:

a body portion comprising the paperclip, the second portion, and a lower portion of the first portion; and a tab portion comprising an upper portion of the first portion that extends beyond a first end of the paperclip, such that when the paperclip tab is coupled to the object, the tab portion extends beyond an edge of the object.

14. The paperclip tab of any of embodiments 1-13, wherein the recessed adhesive zone is located on the body portion of the paperclip tab.

15. The paperclip tab of embodiment 13 or 14, further comprising a multi-layer stack of adhesive-backed sheets of paper coupled to the front surface of the sheet, wherein the multi-layer stack is coupled to at least one of the body portion and the tab portion.

16. The paperclip tab of any of embodiments 13-15, wherein at least one of the body portion and the tab portion is at least one of printable, writable and stainable.

17. The paperclip tab of any of embodiments 13-16, wherein the fold defines at least a portion of a side of the paperclip tab, wherein the tab portion includes a first end of the first sheet, and wherein the first sheet further includes a second end that extends beyond a second end of the second sheet, the second end of the second sheet being generally opposite the first end of the second sheet.

18. The paperclip tab of embodiment 17, wherein the second end of the first portion includes an adhesive on its rear surface that faces the back of the paperclip tab.

19. The paperclip tab of embodiment 18, wherein the adhesive on the rear surface of the second end of the first portion forms at least a portion of the recessed adhesive zone.

20. The paperclip tab of any of embodiments 1-19, wherein the first leg of the paperclip is inserted all the way into the pocket, such that a first end of the paperclip is positioned adjacent a first end of the second portion.

21. The paperclip tab of any of embodiments 1-20, wherein the recessed adhesive zone includes an adhesive positioned on the front surface of the second portion of the sheet and recessed relative to the second leg of the paperclip.

22. The paperclip tab of any of embodiments 1-21, wherein the recessed adhesive zone includes an adhesive that is recessed relative to the second leg of the paperclip that is not positioned in the pocket.

23. The paperclip tab of any of embodiments 1-22, wherein the recessed adhesive zone includes an adhesive that is recessed relative to at least one of a portion of the paperclip, and the second portion of the sheet.

24. The paperclip tab of embodiment 23, wherein the adhesive is recessed until pressure is applied to the front of the paperclip tab adjacent the recessed adhesive zone to activate the adhesive.

25. The paperclip tab of any of embodiments 1-24, wherein the recessed adhesive zone is selectively activated.

26. The paperclip tab of any of embodiments 1-25, wherein the second portion of the sheet includes a cutaway zone formed therethrough and positioned such that when the rear surface of the first portion is adhered to the rear surface of the second portion, the adhesive is exposed across the cutaway zone and recessed from the front surface of the second portion, forming at least a portion of the recessed adhesive zone.

27. The paperclip tab of embodiment 26, wherein the adhesive is further recessed relative to the paperclip.

28. The paperclip tab of embodiment 27, wherein the cutaway zone and the recessed adhesive zone are located adjacent the second leg of the paperclip.

29. The paperclip tab of any of embodiments 1-28, wherein the recessed adhesive zone is selectively activated to adhere to the object at a desired time when the paperclip tab is coupled to the object.

30. The paperclip tab of any of embodiments 1-29, wherein the first leg of the paperclip is shorter than the second leg of the paperclip, such that the shorter leg is positioned in the pocket.

31. The paperclip tab of embodiment 30, wherein at least a portion of the second leg of the paperclip is visible from the front of the paperclip tab.

32. The paperclip tab of embodiment 30 or 31, wherein the first portion includes an opening formed therethrough, such that a bottom end of the second leg of the paperclip is visible through the opening from the front of the paperclip tab.

33. The paperclip tab of any of embodiments 1-32, wherein the first leg of the paperclip tab is longer than the second leg of the paperclip, such that the longer leg is positioned in the pocket.

34. The paperclip tab of any of embodiments 1-33, wherein the first leg of the paperclip is shorter than the second leg of the paperclip, such that the shorter leg is positioned in the pocket, wherein the first portion includes an opening formed therethrough through which a bottom end of the second leg of the paperclip is visible from the front of the paperclip tab, wherein the first portion includes a second end that extends beyond a second end of the second portion and that includes the opening, wherein the rear surface of the second end of the first portion includes an adhesive that is recessed relative to the second leg of the paperclip and the second portion, and wherein the first portion and the second portion are separated by a fold that defines at least a portion of a side of the paperclip tab.

35. The paperclip tab of any of embodiments 1-34, further comprising a multi-layer stack of adhesive-backed sheets of paper coupled to the front surface of the sheet.

36. The paperclip tab of any of embodiments 1-35, wherein at least the front surface of the sheet is at least one of printable, writable and stainable.

37. A paperclip tab for coupling to an object, the paperclip tab comprising:

- a paperclip having a first leg and a second leg that are biased toward one another, such that the paperclip is configured to retain at least a portion of the object between the first leg and the second leg;
- a first sheet having a front surface, and a rear surface opposite the front surface;
- a second sheet having a front surface, and a rear surface opposite the front surface, the second sheet positioned in overlapping relationship over a portion of the first sheet with the rear surface of the first sheet and the rear surface of the second sheet facing each another, such that a pocket is formed between the first sheet and the second sheet, the pocket configured to retain the first leg of the paperclip;
- an adhesive positioned between the first sheet and the second sheet, such that at least a portion of the rear surface of the first sheet is adhered to at least a portion of the rear surface of the second sheet; and
- a recessed adhesive zone on a back of the paperclip tab positioned to face the object when the paperclip tab is coupled to the object.

38. The paperclip tab of embodiment 37, further comprising a cutaway zone formed through the second sheet and positioned over at least a portion of the adhesive positioned between the first sheet and the second sheet, such that when the first sheet and the second sheet are adhered together, the adhesive is exposed across the cutaway zone and is recessed from the front surface of the second sheet, forming the recessed adhesive zone.

39. The paperclip tab of embodiment 37 or 38, wherein the adhesive positioned between the first sheet and the second sheet is the same adhesive that forms at least a portion of the recessed adhesive zone.

40. A method of making a paperclip tab, the paperclip tab configured to be coupled to an object, the method comprising:

- providing a paperclip having a first leg and a second leg that are biased toward one another, such that the paperclip is configured to retain at least a portion of the object between the first leg and the second leg;
- providing a first sheet having a front surface, and a rear surface opposite the front surface;
- providing a second sheet having a front surface, and a rear surface opposite the front surface;
- positioning the second sheet between the first leg and the second leg of the paperclip;
- adhering the rear surface of the first sheet and the rear surface of the second sheet together to form a pocket that is configured to retain the first leg of the paperclip between the first sheet and the second sheet; and
- providing a recessed adhesive zone on a back of the paperclip tab.

41. The method of embodiment 40, wherein adhering the rear surface of the first sheet and the rear surface of the second sheet together includes:

- providing a sheet having a front surface and a rear surface and including an adhesive on the rear surface, the sheet further including a first portion that forms the first sheet and a second portion that forms the second sheet, and
- folding the sheet to bring the rear surface of the first sheet and the rear surface of the second sheet together.

42. The method of embodiment 40 or 41, wherein providing a recessed adhesive zone includes forming a cutaway zone in the second sheet, and adhering the rear surface of the first sheet and the rear surface of the second sheet together such that the cutaway zone in the second sheet overlies an adhesive positioned between the first sheet and the second sheet, such that the adhesive is recessed from the front surface of the second sheet and the back of the paperclip tab.

43. The paperclip tab of any of embodiments 37-39 or the method of any of embodiments 40-42, wherein the paperclip tab further comprises:

- a body portion comprising the paperclip, the second sheet, and a lower portion of the first sheet; and
- a tab portion comprising an upper portion of the first sheet that extends beyond a first end of the paperclip, such that when the paperclip tab is coupled to the object, the tab portion extends beyond an edge of the object.

44. The paperclip tab of any of embodiments 37-39 and 43 or the method of any of embodiments 40-43, wherein the recessed adhesive zone includes an adhesive that is recessed relative to at least one of the second leg of the paperclip and the second sheet.

45. The paperclip tab of any of embodiments 1-39 and 43-44 or the method of any of embodiments 40-44, wherein the first leg of the paperclip is shorter than the second leg of the paperclip.

46. The paperclip tab or the method of embodiment 45, wherein when the first leg of the paperclip is retained in the pocket, and at least a portion of the second leg of the paperclip is visible from a front of the paperclip tab.

47. The paperclip tab of any of embodiments 1-39 and 43-46 or the method of any of embodiments 40-46, wherein the recessed adhesive zone includes a pressure-sensitive adhesive.

48. The paperclip tab of any of embodiments 1-39 and 43-47 or the method of any of embodiments 40-47, wherein the paperclip tab is one of a plurality of paperclip tabs provided in a sheet assembly, each of the plurality of paperclip tabs separated from an adjacent paperclip tab by at least one of a fold and a perforation.

49. The paperclip tab or the method of embodiment 48, wherein at least one side of each of the plurality of paperclip tabs is separated from a side of an adjacent paperclip tab by the at least one of a fold and a perforation.

50. The paperclip tab or the method of embodiment 48, wherein at least one of a first end and a second end of each of the plurality of paperclip tabs is separated from a first end or a second end of an adjacent paperclip tab by the at least one of a fold and a perforation.

The embodiments described above and illustrated in the figures are presented by way of example only and are not intended as a limitation upon the concepts and principles of the present disclosure. As such, it will be appreciated by one having ordinary skill in the art that various changes in the elements and their configuration and arrangement are possible without departing from the spirit and scope of the present disclosure.

All references and publications cited herein are expressly incorporated herein by reference in their entirety into this disclosure.

Various features and aspects of the present disclosure are set forth in the following claims.

What is claimed is:

1. A paperclip tab for coupling to an object, the paperclip tab comprising:

a paperclip having a first leg and a second leg that are biased toward one another, such that the paperclip is configured to retain at least a portion of the object between the first leg and the second leg;

a sheet having a front surface and a rear surface opposite the front surface, the sheet further including a first portion, and a second portion positioned in overlapping relationship over at least a portion of the first portion with the rear surface of the first portion and the rear surface of the second portion facing each another, such that a pocket is formed between the first portion and the second portion, the pocket configured to retain the first leg of the paperclip;

an adhesive positioned between the first portion and the second portion, such that at least a portion of the rear surface of the first portion is adhered to at least a portion of the rear surface of the second portion; and a recessed adhesive zone on a back of the paperclip tab positioned to face the object when the paperclip tab is coupled to the object.

2. The paperclip tab of claim 1, wherein the adhesive is provided on at least the rear surface of the first portion.

3. The paperclip tab of claim 1, wherein the adhesive is provided on the rear surface of the first portion and the rear surface of the second portion.

4. The paperclip tab of claim 1, wherein the first portion and the second portion are formed from the same sheet and are separated by a fold, the fold forming at least a portion of an end or a side of the paperclip tab.

5. The paperclip tab of claim 1, wherein the paperclip tab further comprises:

a body portion comprising the paperclip, the second portion, and a lower portion of the first portion; and a tab portion comprising an upper portion of the first portion that extends beyond a first end of the paperclip, such that when the paperclip tab is coupled to the object, the tab portion extends beyond an edge of the object.

6. The paperclip tab of claim 5, further comprising a multi-layer stack of adhesive-backed sheets of paper coupled to the front surface of the sheet, wherein the multi-layer stack is coupled to at least one of the body portion and the tab portion.

7. The paperclip tab of claim 5, wherein at least one of the body portion and the tab portion is at least one of printable, writable and stainable.

8. The paperclip tab of claim 5, wherein the fold defines at least a portion of a side of the paperclip tab, wherein the tab portion includes a first end of the first portion of the sheet, and wherein the first portion further includes a second end that extends beyond a second end of the second portion of the sheet, the second end of the second portion being generally opposite the first end of the second portion.

9. The paperclip tab of claim 8, wherein the second end of the first portion includes an adhesive on its rear surface that faces the back of the paperclip tab.

10. The paperclip tab of claim 1, wherein the recessed adhesive zone includes an adhesive positioned on the front surface of the second portion of the sheet and recessed relative to the second leg of the paperclip.

11. The paperclip tab of claim 1, wherein the recessed adhesive zone includes an adhesive that is recessed relative to the second leg of the paperclip that is not positioned in the pocket.

12. The paperclip tab of claim 1, wherein the recessed adhesive zone includes an adhesive that is recessed relative to at least one of a portion of the paperclip, and the second portion of the sheet.

13. The paperclip tab of claim 1, wherein the first leg of the paperclip is shorter than the second leg of the paperclip, such that the shorter leg is positioned in the pocket, and wherein the first portion includes an opening formed therethrough, such that a bottom end of the second leg of the paperclip is visible through the opening from the front of the paperclip tab.

14. The paperclip tab of claim 1, wherein the first leg of the paperclip tab is longer than the second leg of the paperclip, such that the longer leg is positioned in the pocket.

15. The paperclip tab of claim 1, wherein the first leg of the paperclip is shorter than the second leg of the paperclip, such that the shorter leg is positioned in the pocket, wherein the first portion includes an opening formed therethrough through which a bottom end of the second leg of the paperclip is visible from the front of the paperclip tab, wherein the first portion includes a second end that extends beyond a second end of the second portion and that includes the opening, wherein the rear surface of the second end of the first portion includes an adhesive that is recessed relative to the second leg of the paperclip and the second portion, and wherein the first portion and the second portion are separated by a fold that defines at least a portion of a side of the paperclip tab.

16. The paperclip tab of claim 1, wherein the first leg of the paperclip is shorter than the second leg of the paperclip.

17. The paperclip tab of claim 16, wherein when the first leg of the paperclip is retained in the pocket, and at least a portion of the second leg of the paperclip is visible from a front of the paperclip tab.

18. The paperclip tab of claim 1, wherein the paperclip tab is one of a plurality of paperclip tabs provided in a sheet assembly, each of the plurality of paperclip tabs separated from an adjacent paperclip tab by at least one of a fold and a perforation.

19. A paperclip tab for coupling to an object, the paperclip tab comprising:

a paperclip having a first leg and a second leg that are biased toward one another, such that the paperclip is configured to retain at least a portion of the object between the first leg and the second leg;

a sheet comprising a front surface and a rear surface opposite the front surface, and further including an adhesive on the rear surface, the sheet folded to form a pocket between the rear surface of a first portion of the sheet and the rear surface of a second portion of the sheet, the first leg of the paperclip being positioned in the pocket; and a recessed adhesive zone on a back of the paperclip tab, the recessed adhesive zone positioned to face the object when the paperclip tab is coupled to the object.

20. The paperclip tab of claim 19, wherein the fold forms at least a portion of an end or a side of the paperclip tab.

21. A paperclip tab for coupling to an object, the paperclip tab comprising:

a paperclip having a first leg and a second leg that are biased toward one another, such that the paperclip is configured to retain at least a portion of the object between the first leg and the second leg;

a first sheet having a front surface, and a rear surface opposite the front surface;

a second sheet having a front surface, and a rear surface opposite the front surface, the second sheet positioned in overlapping relationship over a portion of the first sheet with the rear surface of the first sheet and the rear surface of the second sheet facing each another, such that a pocket is formed between the first sheet and the second sheet, the pocket configured to retain the first leg of the paperclip;

an adhesive positioned between the first sheet and the second sheet, such that at least a portion of the rear surface of the first sheet is adhered to at least a portion of the rear surface of the second sheet; and a recessed adhesive zone on a back of the paperclip tab positioned to face the object when the paperclip tab is coupled to the object.

22. A method of making a paperclip tab, the paperclip tab configured to be coupled to an object, the method comprising:

providing a paperclip having a first leg and a second leg that are biased toward one another, such that the paperclip is configured to retain at least a portion of the object between the first leg and the second leg;

providing a first sheet having a front surface, and a rear surface opposite the front surface;

providing a second sheet having a front surface, and a rear surface opposite the front surface;

positioning the second sheet between the first leg and the second leg of the paperclip;

adhering the rear surface of the first sheet and the rear surface of the second sheet together to form a pocket that is configured to retain the first leg of the paperclip between the first sheet and the second sheet; and providing a recessed adhesive zone on a back of the paperclip tab.

23. The method of claim 22, wherein adhering the rear surface of the first sheet and the rear surface of the second sheet together includes:

providing a sheet having a front surface and a rear surface and including an adhesive on the rear surface, the sheet further including a first portion that forms the first sheet and a second portion that forms the second sheet, and folding the sheet to bring the rear surface of the first sheet and the rear surface of the second sheet together.

* * * * *